US012365433B2

(12) United States Patent
Schofield et al.

(10) Patent No.: US 12,365,433 B2
(45) Date of Patent: Jul. 22, 2025

(54) PROPULSION DEVICE

(71) Applicant: BA Technologies Limited, Poole (GB)

(72) Inventors: Simon James Schofield, Poole (GB); George Frank Jack Thompson, Sussex (GB)

(73) Assignee: BA Technologies Limited (GB)

( * ) Notice: Subject to any disclaimer, the term of this patent is extended or adjusted under 35 U.S.C. 154(b) by 475 days.

(21) Appl. No.: 17/782,356

(22) PCT Filed: Dec. 4, 2020

(86) PCT No.: PCT/GB2020/053124
§ 371 (c)(1),
(2) Date: Jun. 3, 2022

(87) PCT Pub. No.: WO2021/111147
PCT Pub. Date: Jun. 10, 2021

(65) Prior Publication Data

US 2023/0002023 A1 Jan. 5, 2023

(30) Foreign Application Priority Data

Dec. 4, 2019 (GB) ..... 1917715
Sep. 24, 2020 (GB) ..... 2015124

(51) Int. Cl.
*B63H 9/06* (2020.01)
*B63B 79/15* (2020.01)
(Continued)

(52) U.S. Cl.
CPC ..... *B63H 9/0635* (2020.02); *B63B 79/15* (2020.01); *B63B 79/40* (2020.01)

(58) Field of Classification Search
CPC ... B63H 9/00; B63H 9/04; B63H 9/06; B63H 9/0635; B63B 79/00; B63B 79/15; B63B 79/40
(Continued)

(56) References Cited

U.S. PATENT DOCUMENTS 4,453,483 A 6/1984 Shallenberger
4,467,741 A * 8/1984 Walker ..... B63H 9/061 114/102.22
(Continued)

FOREIGN PATENT DOCUMENTS

CN 104903190 A 9/2015
CN 105697236 A 6/2016
(Continued)

OTHER PUBLICATIONS

International Search Report dated Mar. 15, 2021, issued by the European Patent Office in International Application No. PCT/GB2020/053124; 5 pages.
(Continued)

*Primary Examiner* — Lars A Olson
(74) *Attorney, Agent, or Firm* — Klarquist Sparkman, LLP

(57) ABSTRACT

A wingsail for a powered watercraft comprising a first aerofoil element, a second aerofoil element, and a third aerofoil element, wherein each of the aerofoil elements is rotatable about an axis and has an aerofoil section with a centre of area which is closer to its leading edge than its trailing edge, and the aerofoil elements are movable to a configuration in which flow from the trailing edge of one of the first or third element is directed toward the leading edge of the second element, and flow from the trailing edge of the second element is directed toward the leading edge of the other of the first or third element.

27 Claims, 16 Drawing Sheets

(51) Int. Cl.
*B63B 79/40* (2020.01)
*B63H 9/061* (2020.01)

(58) Field of Classification Search
USPC ..... 114/102.16
See application file for complete search history.

(56) References Cited

U.S. PATENT DOCUMENTS

| | | | |
|---|---|---|---|
| 4,770,113 | A | 9/1988 | Walker |
| 4,848,258 | A | 7/1989 | Priebe |
| 4,856,449 | A | 8/1989 | Walker |
| 10,906,620 | B2 | 2/2021 | Peteghem et al. |
| 2014/0017970 | A1 | 1/2014 | Comfort |
| 2015/0000578 | A1 | 1/2015 | Strebe et al. |
| 2015/0158569 | A1 | 6/2015 | Decamp et al. |
| 2015/0321745 | A1 | 11/2015 | Bray |
| 2018/0148356 | A1 | 5/2018 | Bermudez Miquel et al. |
| 2018/0215453 | A1 | 8/2018 | Asscher |

FOREIGN PATENT DOCUMENTS

| | | | |
|---|---|---|---|
| EP | 0061291 | A2 | 3/1982 |
| EP | 3299275 | A1 | 3/2018 |
| FR | 2559449 | A1 | 8/1985 |
| GB | 2216858 | A | 3/1989 |
| KR | 10-2019-0125285 | B1 | 11/2019 |
| SU | 1558771 | A1 | 4/1990 |
| WO | WO 2014/001824 | A1 | 1/2014 |
| WO | WO 2014/033386 | A1 | 3/2014 |
| WO | WO 2015/155518 | A2 | 10/2015 |
| WO | WO 2016/142566 | A1 | 6/2016 |

OTHER PUBLICATIONS

Written Opinion dated Mar. 15, 2021, issued by the European Patent Office in International Application No. PCT/GB2020/053124; 7 pages.

* cited by examiner

PROPULSION DEVICE

CROSS REFERENCE TO RELATED APPLICATIONS

This is the § 371 U.S. National Stage of International Application No. PCT/GB2020/053124, filed Dec. 4, 2020, which was published in English under PCT Article 21(2), which in turn claims the benefit of UK Application No. GB 1917715.3, filed Dec. 4, 2010 and UK Application No. GB 2015124.7, filed Sep. 24, 2020, which applications are incorporated herein in their entirety.

BACKGROUND OF THE INVENTION

The present invention relates to a device for propelling a powered watercraft, and in particular a wingsail.

A widely proposed approach for reducing the emissions of powered watercraft having an engine to provide propulsive power to the ship (such as ships or superyachts) is the use of wind energy to provide some or all of the power used to propel the vessel. This wind propulsion may thus reduce the power required from the ship's main drivetrain. This may reduce the fuel consumption of the ship's driving engines, which may in turn lead to a reduction in greenhouse gas emissions. This process, in addition, may also reduce the operational cost of the ship by reducing the amount of fuel used for a given journey.

Wind powered watercraft have been in use for many centuries, and more recently, wind assisted technologies have been applied to powered watercraft such as ships as described above. Wind technologies in this field are wide ranging and include many different designs and features of which predominantly aim to achieve a high lift to drag ratio, as is a preferred configuration for a sailing yacht.

In some known arrangements, a two-element rigid wingsail has been applied to a watercraft. However, such wingsails are typically designed with a high lift-to-drag ratio in mind, which may limit the absolute power available from the wingsails.

Conventionally, a high lift wing (such as is used in, for example, the aerospace and automotive industries), uses an aerofoil with a cambered shape. This shape increases the pressure differential between each side of the wing for a given angle of attack and therefore increases the achievable lift of the wing.

The maximum lift a wing is able to produce is governed by the onset of stall, in which the flow over the wing 'detaches' at a critical angle of attack, leading to a significant reduction in lift. To increase an aerofoil's achievable critical angle of attack before stall, and thus increase the lift it is able to produce, the flow on the low-pressure side of the wing may be regenerated. This can be achieved by splitting the wing into two parts (a leading wing and a trailing wing), positioned in such a way to produce a carefully dimensioned slot between the trailing edge of the leading wing and the leading edge of the trailing wing. This slot may provide the low pressure 'suction' side of the wing with a stream of high energy flow which helps to keep the flow attached and delay the onset of stall, or prevent the onset of stall up to a certain angle. This effect is very sensitive to the exact width of the slot and thus the positioning of the elements needs to be carefully controlled. Further, to generate a higher lift coefficient, a higher camber is typically used. A two element wing is able to produce a limited amount of camber before stall.

Further, an aerofoil with a cambered shape is typically designed to produce lift in only one direction (i.e. a vector from the concave to the convex side of the aerofoil). On a ship however, the direction of the force produced by an aerofoil may need to be changed (and indeed may need to be reversed), depending on whether the ship is on a starboard or port tack. Typically, this can be achieved by using either a symmetrical aerofoil, a soft sail which deforms to invert its camber, or a cambered aerofoil which has its shape mirrored from front to back. However, such arrangements may result in an aerofoil which is not optimal in shape. It is an aim of the present invention to provide a wingsail of optimal shape and which is able to invert its camber.

In some known arrangements, a two-element wingsail is provided with a flap, sometimes known as a "tail". This tail is usually situated a large distance aft of the wingsail's rotation point. This arrangement varies from that of the present invention in that these tail elements are rotated in such a way so as to produce lift in the opposite direction to the other two elements of the wingsail, in order to naturally induce an angle of attack of the wingsail to the apparent wind. This tail element may thus remove the need for control lines and trimming by manual or powered means, but the lift produced by the tail element may be detrimental to the total lift of the wingsail. It will be understood by those skilled in the art that the "tail" arrangement does not provide the 'slot' effect mentioned above, and does not result in a high lift wing. In the present invention, each of the aerofoil elements are set at an angle so as to produce lift along a vector from the concave to the convex side.

Few of the proposals for wind-assistance for modern ships have achieved commercial acceptance. Structures on the loading area of a ship may inhibit efficient loading and unloading, and their provision increases both the capital cost of the ship and the maintenance burden, which means that the operational savings need to be sufficient to make them economically viable. In situations where the wind direction is not assisting the passage of the ship, the presence of the sails may contribute to windage and thus increase fuel consumption.

It is an aim of the present invention to at least partially address the problems noted above.

SUMMARY OF INVENTION

According to the present disclosure, there is provided a wingsail for a powered watercraft comprising a first aerofoil element, a second aerofoil element, and a third aerofoil element, with each of the aerofoil elements having first and second opposed edges. Each of the aerofoil elements is rotatable about an axis and has an aerofoil section with a centre of area which is closer to its leading edge than its trailing edge, and the aerofoil elements are movable to a configuration in which flow from the second edge of one of the first or third element is directed toward the first edge of the second element, and flow from the second edge of the second element is directed toward the first edge of the other of the first or third element. The first edge may be the leading edge of the respective element, and the second edge may be the trailing edge of the respective element. This may provide a high lift wingsail capable of providing a large propulsive force to the watercraft.

Optionally, the aerofoils are arranged in an array so as to together form a cambered shape. This may provide a high lift configuration.

Optionally, at least two of the aerofoil elements are configured to rotate to thereby reverse the camber of the cambered shape.

Optionally, the first and third aerofoil elements are configured to rotate in opposite rotational directions to each other to thereby reverse the camber of the cambered shape.

Optionally, the aerofoil elements are movable between a first configuration in which flow from the second edge of the first element is directed toward the first edge of the second element, and flow from the second edge of the second element is directed toward the first edge of third element, and a second configuration in which flow from the second edge of the third element is directed toward the first edge of the second element, and flow from the second edge of the second element is directed toward the first edge of first element. Thus, in both the first and second configurations, the flow travels over the aerofoil elements in the same direction relative to the individual aerofoil elements. This may allow the camber of the array to be inverted.

Optionally, the first aerofoil element is rotatable relative to the second aerofoil element.

Optionally, the third aerofoil element is rotatable relative to the second aerofoil element.

Optionally, the first and/or third aerofoil element is configured to rotate relative to the second aerofoil element by at most 110 degrees, and preferably at most 90 degrees.

Optionally, each of the aerofoil elements is independently rotatable relative to each of the other aerofoil elements about its respective rotational axis. This may allow the wingsail to be used in multiple apparent wind conditions.

Optionally, the aerofoil elements are configured to be positioned such that slots are formed between the first aerofoil element and the second aerofoil element, and between the second aerofoil element and the third aerofoil element, the slots being configured to regenerate airflow over the suction side of the aerofoil elements. This may delay stall of the aerofoil elements, and allow higher lift to be generated.

Optionally, the size of the slots is such that the distance between the leading edge and trailing edge of adjacent aerofoils is 20% or less of the chord of at least one of the aerofoils.

Optionally, the rotational axis of the first aerofoil element is located between the leading edge and the trailing edge of the first aerofoil element.

Optionally, the rotational axis of the first aerofoil element is located between the leading edge and the trailing edge of the second aerofoil element.

Optionally, the rotational axis of the third aerofoil element is located between the leading edge and the trailing edge of the second aerofoil element.

Optionally, the rotational axis of the third aerofoil element is located between the leading edge and the trailing edge of the third aerofoil element.

Optionally, each respective rotational axis is located between the leading edge and the trailing edge of its respective aerofoil element. This may allow the aerofoil elements to be easily moved when changing camber.

Optionally, the rotational axis of each aerofoil element is located closer to the leading edge than the trailing edge of each respective aerofoil element.

Optionally, the rotational axis of each aerofoil element is located in the first third of the chord from the leading edge, preferably at a location between 15% and 35% of the chord from the leading edge, more preferably at a location between 20% and 30% of the chord from the leading edge.

Optionally, the rotational axis of the second element is offset with respect to a plane extending between the axes of the first and third elements. This may provide the cambered shape.

Optionally, each of the rotational axes are parallel to each other.

Optionally, the aerofoil elements are symmetrically shaped about their chord line. This may allow the order of the elements to be reversed in order to change the camber.

Optionally, the distance from the thickest portion of each aerofoil element to the leading edge is less than the distance from the thickest portion of each aerofoil element to the trailing edge.

Optionally, the section of each aerofoil is substantially uniform along the span of the aerofoil.

Optionally, the wingsail, further comprises a fourth aerofoil element, the fourth aerofoil element having an aerofoil section with a centre of area which is closer to its leading edge than its trailing edge, wherein the aerofoil elements are movable to a configuration in which flow from the trailing edge of the third element is directed toward the leading edge of the fourth element. This may provide further control over the camber of the wingsail.

Optionally, the fourth aerofoil element is independently rotatable relative to the other aerofoil elements about a rotational axis located between the leading edge and the trailing edge of the fourth aerofoil element.

Optionally, at least one of the aerofoil elements is divided into two or more portions distributed along the span of the aerofoil, each portion being independently rotatable relative to the other portions. This may provide improved control.

Optionally, the aerofoil elements are rotatable to a weathercocked configuration in which the chord line of each aerofoil is substantially aligned with an apparent wind direction. This may allow provide a failsafe configuration, in which the wingsails are not used to generate any substantial propulsive force.

Optionally, the aerofoil elements are biased to the weathercocked configuration by one or more resilient biasing members.

Optionally, the aerofoil elements are rotatable to a stowed configuration in which the chord lines of each aerofoil element are substantially parallel to each other and the trailing edges of the first and third aerofoil are facing each other. This may allow the size of the wingsail to be reduced or minimised for storage.

Optionally, at least one of the aerofoils comprises a leading edge slat and/or one or more boundary layer fences. This may further increase the lift of the wingsail.

Optionally, the second aerofoil is mounted to a main spar arranged to support the weight of the wingsail. This may provide convenient mounting of the wingsail to the watercraft.

Optionally, the aerofoils are mounted on a base plate and are rotatable relative to the base plate, the base plate being rotatably mounted on the main spar. This may allow the entire wingsail to be rotated relative to the watercraft. The entire wingsail may also be rotatable relative to the watercraft by using other arrangements.

Optionally, the wingsail further comprises an end plate mounted at the opposite end of the span of the aerofoils to the base plate such that the aerofoils are mounted between the base plate and the end plate, the end plate being rotatably mounted on the main spar.

Optionally, the aerofoils are arranged such that the rotational axes of at least two of the aerofoil elements are moveable relative to each other.

According to the present disclosure, there is also provided a system comprising a wingsail as described above, and a controller arranged to control the rotation of the aerofoil elements. This may allow the wingsail to be adjusted when mounted on a watercraft.

Optionally, the controller is arranged to rotate the aerofoils automatically in response to at least one of a measured wind condition, a measured force on the wingsail and a measured moment on the wingsail. This may provide increased fuel efficiency.

Optionally, the aerofoil elements are arranged in an array so as to together form a cambered shape, and the controller is arranged to rotate at least two of the aerofoil elements to thereby reverse the camber of the cambered shape According to the present disclosure, there is also provided a watercraft comprising a wingsail as described above. For example, the watercraft may be a watercraft powered by an engine, such as a ship, a bulk carrier or a superyacht.

BRIEF DESCRIPTION OF THE DRAWINGS

The present invention will now be described, by way of non-limitative example only, with reference to the accompanying drawings, in which.

DETAILED DESCRIPTION

Figure 1:
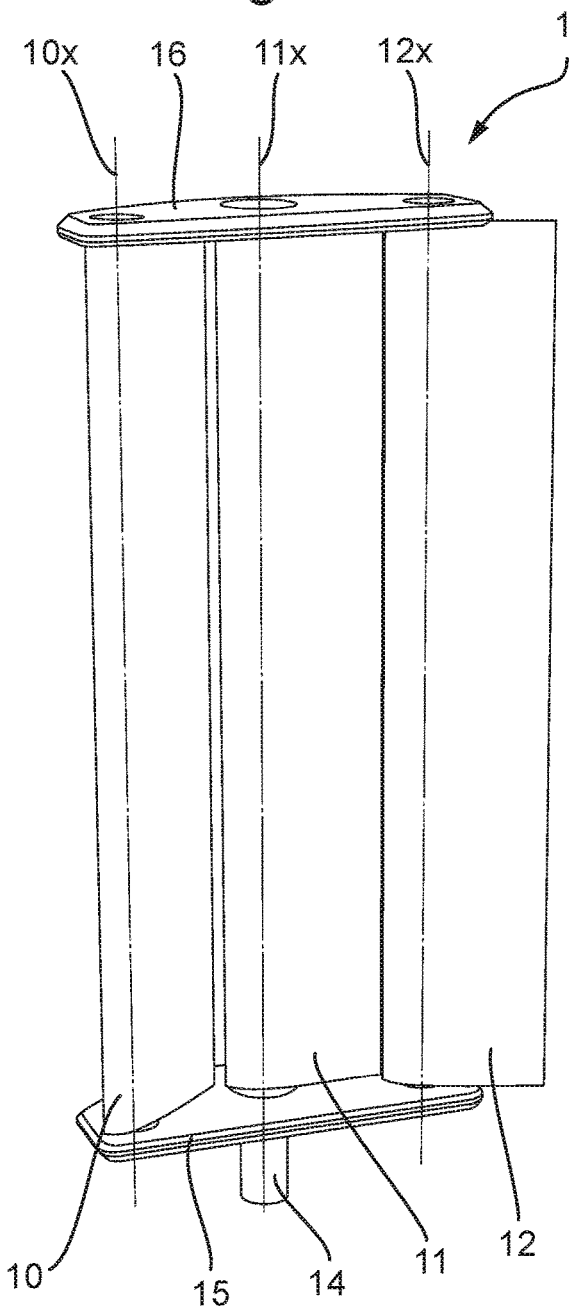
FIG. 1 shows a perspective view of a wingsail according to the present invention.
Figure 2:
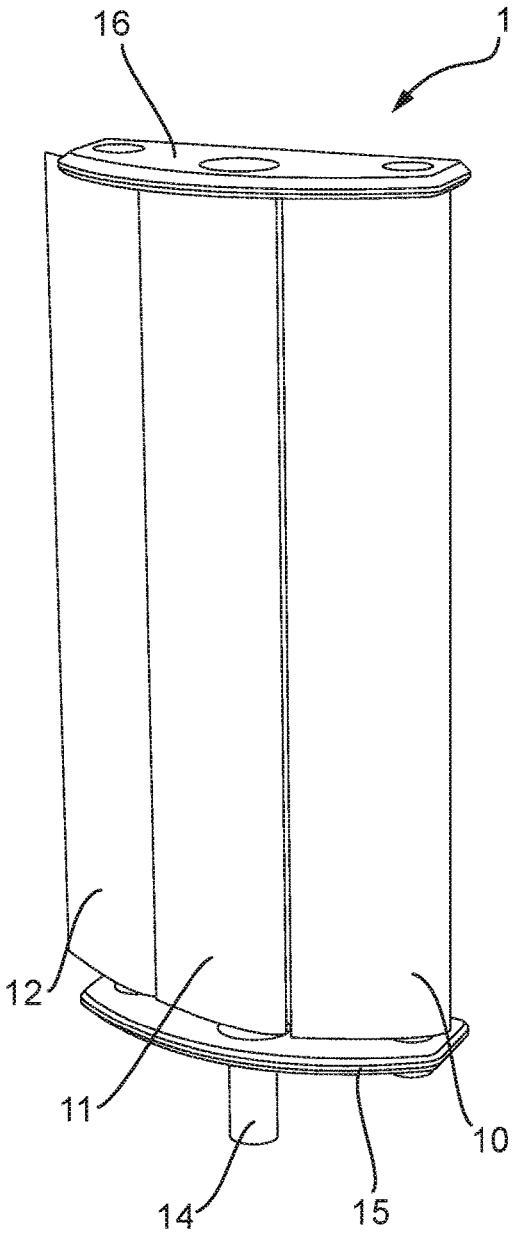
FIG. 2 shows a second perspective view of a wingsail according to the present invention.

The present invention relates to a wingsail 1 for a powered watercraft. That is, the wingsail 1 is a device which can be mounted to a powered watercraft (e.g. a ship) in order to provide wind propulsion to the watercraft. As shown in FIGS. 1 and 2, the wingsail 1 includes a first aerofoil element 10, a second aerofoil element 11, and a third aerofoil element 12.

As shown in FIG. 1, each of the aerofoil elements is rotatable about an axis. That is, the first aerofoil 10 is rotatable about a first axis 10*x*, the second aerofoil 11 is rotatable about a second axis 11*x*, and the third aerofoil 12 is rotatable about a third axis 12*x*. Each aerofoil element may be independently rotatable relative to the other aerofoil elements about its respective axis.

Figure 3:
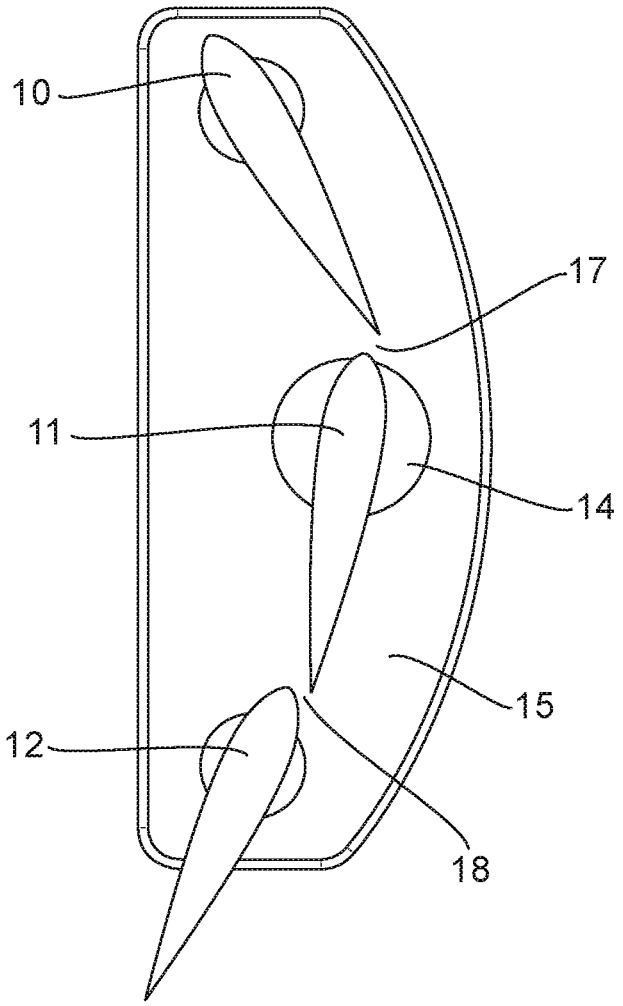
FIG. 3 shows a cross-sectional plan view of a wingsail according to the present invention.

As also shown in (for example) FIG. 3, each of the aerofoil elements has an aerofoil section with a centre of area which is closer to its leading edge than to its trailing edge. In other words, the distance from the leading edge to the centre of area is less than the distance from the trailing edge to the centre of area. That is, the section of the aerofoil (i.e. cut along the chord line, perpendicular to the spanwise direction) is such that the cross-sectional area of the aerofoil which is forward of the midpoint of the chord line is larger than the cross-sectional area which is to the rear of the chord line. Thus, more than half of the area of the aerofoil section is closer to the leading edge (of the aerofoil) than to the trailing edge (of the aerofoil), and the aerofoil is asymmetric about a line perpendicular to the chord at 50% chord. This may mean that the distance from the thickest portion of each aerofoil element to the leading edge is less than the distance from the thickest portion of each aerofoil element to the trailing edge. This may result in a more efficient aerofoil shape, and allows the leading and trailing edges of the aerofoil to be specifically designed as such.

As best shown in the plan view of FIG. 3, the aerofoils 10, 11, 12 can be moved to a configuration in which flow from the trailing edge of the first aerofoil element 10 is directed towards the leading edge of the second aerofoil element 11, and flow from the trailing edge of the second aerofoil element 11 is directed towards the leading edge of the third aerofoil element 12. It will be noted that together, the aerofoils form an array which has a cambered shape. Thus, air flow which impinges on the array at the first aerofoil element 10 is directed in succession to the second and third aerofoil elements, and flows around the array. It will be appreciated that in the array, each of the aerofoil elements provides lift along a vector from the concave to the convex side of the cambered array. When, as described above, each aerofoil element is independently rotatable relative to the other aerofoil elements, this rotation, combined with the aerofoil elements having a centre of area in section which is closer to its leading edge than its trailing edge, may, as described below, allow the camber of the array to be inverted.

It will be understood that the aerofoil elements in this orientation are aligned so as to produce a slot between the trailing edge of an aerofoil element and the leading edge of a following aerofoil element, to produce the effect described previously. In other words, a slot is provided between the first aerofoil element and the second aerofoil element, and between the second aerofoil element and the third aerofoil element. In the arrangement shown in FIG. 3, a first slot 17 is formed between the trailing edge of the first aerofoil element 10 and the leading edge of the second aerofoil element 11, and a second slot 18 is formed between the trailing edge of the second aerofoil element 11 and the leading edge of the third aerofoil element 12.

The slots between the aerofoil elements may provide a passage for high pressure airflow from the high pressure side of the cambered array to the suction side (i.e. the low pressure side) of the cambered array (and thus to the suction side of the individual elements). This may "regenerate" the airflow and keep the airflow attached. In turn, this may delay the onset of stall, allowing the wingsail to produce higher lift. It will be understood that, by moving the aerofoil elements relative to each other, the size of the slots may be controlled. In some arrangements, the slots may be dimensioned such that the distance between the trailing edge of one aerofoil element and the leading edge of the next aerofoil element is less than 20% of the chord of one or both of the aerofoil elements. That is, the size of the slot is relatively small compared to the size of the aerofoil elements.

The arrangement described above allows a very high lift configuration to be realised. Rather than the conventional approach of designing a wingsail using a high lift to drag ratio, the absolute lift of the wingsail can be maximised. This may be particularly advantageous to ships for a number of reasons. First, although the predominant apparent wind angle experienced by a ship on a typical passage is small (due to the ship's forward speed), the potential fuel saving achieved by a wingsail optimised for larger apparent wind angles (i.e. optimised to produce high lift) is large compared to that of a wingsail which is optimised for smaller apparent wind angles (i.e. optimised for a high lift to drag ratio). Second, a ship generally has high stability, and thus is able to accommodate a wingsail which is able to produce a large amount of lift without the need to depower. Third, at apparent wind angles greater than 90 degrees, both lift and drag of the wingsail provide thrust to the ship, and so at these angles both high lift and high drag are beneficial.

In situations where the ship experiences a small apparent wind angle, and a high lift to drag ratio is advantageous, the wingsail of the present invention can simply be depowered to produce a lower lift force, and therefore, a lower induced drag, to increase its lift to drag ratio.

Each of the aerofoil elements may be of a rigid construction. That is, each of the aerofoil elements 10, 11, 12 is formed of a rigid material so that, in contrast to a conventional flexible sail for a boat, the shape of the elements does not change substantially in response to the wind or other forces. It will be understood that a rigid construction is a construction such that when there is no flow over the aerofoil, the shape of the aerofoil is maintained. Such a construction may be an aerofoil of which the outer surface is formed of a rigid material, such as a metal, a composite or a plastics material, or may have a rigid frame, with a flexible or formable skin disposed over the frame. The use of rigid aerofoil elements may also allow for improved control over the dimensions of this slot (or slots) mentioned above along the total span of the wingsail.

As shown in FIGS. 1-3, the second aerofoil element 11 may be mounted on a main spar 14, which is able to rotate in relation to the ship. The main spar may be mounted to the deck, and may extend through (i.e. be mounted through) the deck and extend into the main body of the hull. The main spar may pivot around its axis on a bearing arrangement. The second aerofoil 11 may either be fixed relative to, or be rotatable about (i.e. relative to) the main spar 14. The aerofoils 10 and 12 may be mounted between a base plate 15 and an end plate 16 which may themselves be mounted on the main spar 14. The base plate 15 and the end plate 16 may also be rotatable about (i.e. relative to) the main spar 14. Thus, the first and third aerofoils 10 and 12 can rotate relative to the main spar, and the second aerofoil 11 is able to rotate with the main spar or independently of it.

In alternative embodiments the main spar 14 may act as a mounting for any one of the other aerofoil elements, e.g. the first aerofoil element 10 or the last aerofoil element 12 in the sequence of aerofoils, with the remaining aerofoil elements being mounted to the base plate 15 and end plate 16. In a further alternative, all aerofoil elements may be mounted between the base plate and end plate, to form an assembly, with the whole assembly being rotatably mounted, e.g. by the base plate 15 being on a on a rotatable mount.

In some arrangements, one or more parts of the aerofoil may extend such that they protrude outside of the base plate when viewed in cross section, as shown in, for example, FIG. 3. However, it will be understood that the shape of the base plate and end plate are not limited to the shape shown in the Figures, and may be of any suitable shape. For example, the base plate and end plate may be shaped such that the ends of the aerofoil in the spanwise direction are covered by the end plates when in the configuration shown in FIG. 3.

If the wind changes direction, or the vessel changes direction relative to the wind, it may be required to change the tack of the wingsail by changing the direction of camber of the wingsail. A simplified example of the way in which the wingsail may be tacked will now be described with reference to FIGS. 4-8, where the wind changes from impinging the wingsail from the top of the page to impinging from the bottom of the page. It will be understood that this example is schematic, and the precise order of movements need not be as described below.

Figure 4:
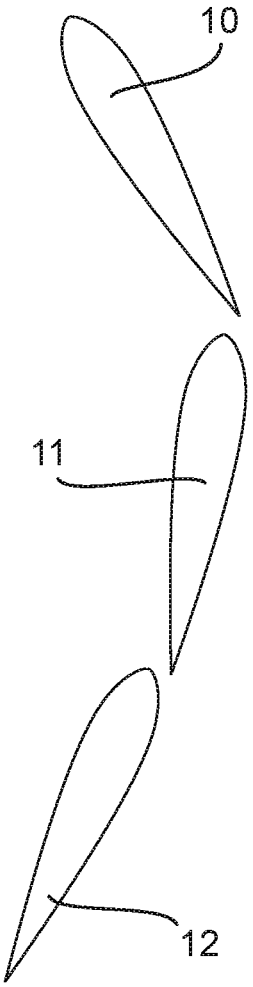
FIG. 4 shows a plan view of the aerofoils of the wingsail of the present invention, before initiation of a tack.

FIG. 4 shows the aerofoils 10, 11, 12 in the same configuration as those in FIG. 3. For clarity, the remaining components of the wingsail 1 are omitted.

Figure 5:
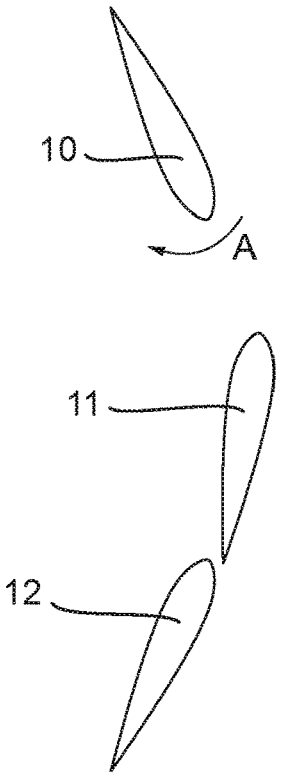
FIG. 5 shows a first stage of changing tack of the aerofoils of FIG. 4.
Figure 6:
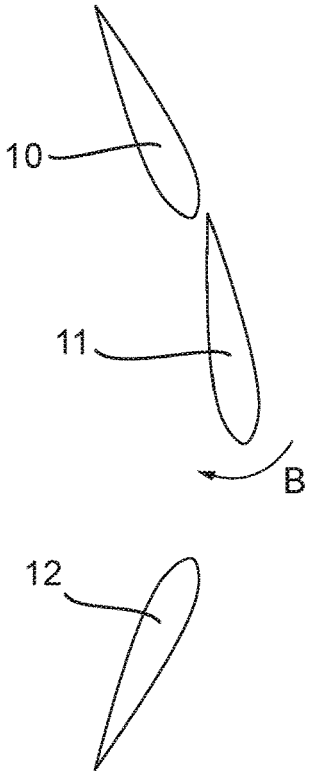
FIG. 6 shows a second stage of changing tack of the aerofoils of FIG. 4.

First, as shown in FIG. 5, the first aerofoil element 10 is rotated about approximately 180 degrees, as shown by arrow A in FIG. 5. Next, the second aerofoil element 11 is rotated about approximately 180 degrees, as shown by arrow B in FIG. 6.

Figure 7:
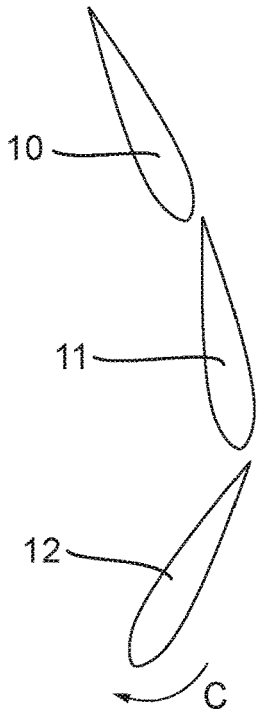
FIG. 7 shows a third stage of changing tack of the aerofoils of FIG. 4.

Then, the third aerofoil element 12 is rotated about approximately 180 degrees, as shown by arrow C in FIG. 7. Thus, each of the aerofoil elements 10, 11, 12 is rotated, which results in the camber of the combined array being reversed, and the wing to have completed a tack.

Figure 8:
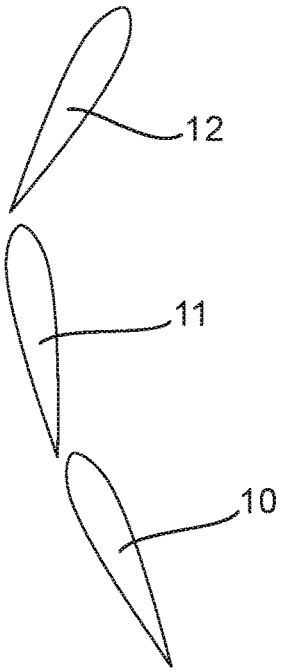
FIG. 8 shows the aerofoils of FIG. 7 rotated about 180 degrees, relative to FIG. 4.

The reversed camber can best be seen in FIG. 8, which is a version of FIG. 7 rotated by 180 degrees. It will be appreciated that such a rotation need not be carried out as part of a tacking process, but merely serves for easy comparison with FIG. 4. From a comparison of FIG. 4 with FIGS. 7 and 8, it will be noted that, due to this process, the overall camber of the aerofoil array has been reversed (or inverted), and thus the direction of the lift force changes by 180 degrees. That is, the aerofoils have moved from a first configuration in which flow from the trailing edge of the first element 10 is directed toward the leading edge of the second element 11, and flow from the trailing edge of the second element 11 is directed toward the leading edge of third element 12, to second a configuration in which flow from the trailing edge of the third element 12 is directed toward the leading edge of the second element 11, and flow from the trailing edge of the second element 11 is directed toward the leading edge of first element 10. It will be understood that in both the first and second configurations, the flow travels over the aerofoil elements in the same direction relative to the individual aerofoil elements. It will also be understood that, after this change, a slot is formed between the trailing edge of the third aerofoil element 12 and the leading edge of the second aerofoil element 11, and a slot is formed between the trailing edge of the second aerofoil element 11 and the leading edge of the first aerofoil element 10.

FIGS. 9-13 shows another example of the tacking process, with the addition of the base plate 15. In these Figures, the wind direction is shown, as well as the lift force produced by the wingsail in FIGS. 9 and 13. This tacking process may be used for a configuration in which the second aerofoil element 11 is rotatably mounted to the main spar, and the base and end plate are able to rotate in relation to the main spar. The process is shown as a series of discrete movements so that the interactions between each part of the wingsail assembly can be understood. However, it will be understood that the various parts of the wingsail need not move in the particular sequence of discrete movements as described herein. In some arrangements, all of the parts (or a subset of the parts) may be moved at the same time in a synchronous manner so that during the tacking process each aerofoil element will have its chord line aligned to the apparent wind (this is shown in a further example below).

Figure 9:
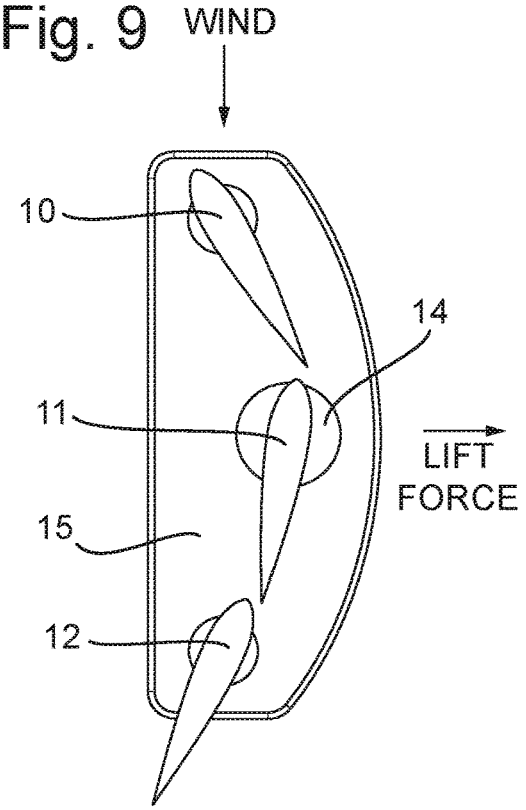
FIG. 9 shows a view of FIG. 3 with an impinging wind and lift force before changing tack.

In FIG. 9, the wind impinges on the wingsail from the direction in the top of the Figure. The air flows around the wingsail (i.e. over the aerofoil elements), and produces a resultant lift force, (i.e. the component of the total force from the wingsail which acts perpendicular to the onset of flow) to the right in the view shown in the Figure. The positions of the aerofoil are such that the wingsail provides high lift in that direction.

Figure 10:
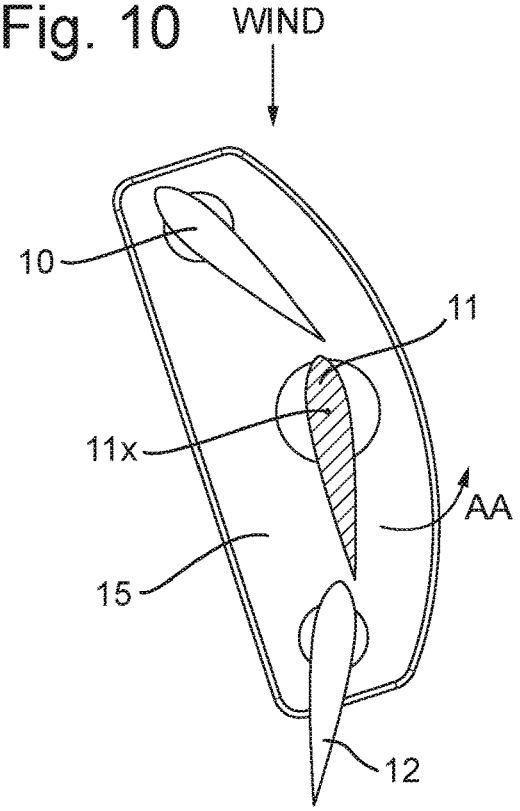
FIG. 10 shows a first stage of changing tack of the aerofoils of FIG. 9.

The first stage of the tacking process is shown in FIG. 10. The second aerofoil element 11 and the main spar 14 rotate anticlockwise, as shown by arrow AA. The base plate also rotates with the main spar. Because the first and third aerofoil elements 10, 12 are mounted to the base plate, they rotate relative to the ship, about the axis of rotation of the second aerofoil element 11*x*, but do not yet rotate relative to the second aerofoil element 11 or the base plate. It will be noted that in FIG. 10, the second aerofoil is positioned in its final position (i.e. that shown in FIG. 13).

Figure 11:
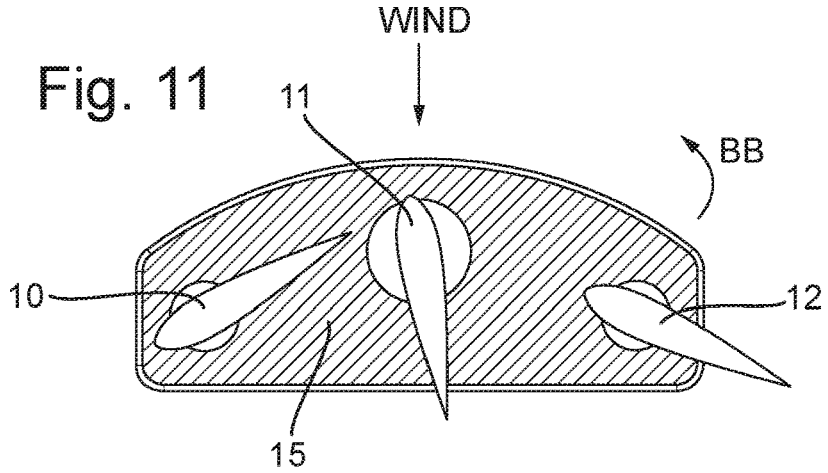
FIG. 11 shows a second stage of changing tack of the aerofoils of FIG. 9.

Next, as shown in FIG. 11, the base plate continues to rotate relative to the main spar, as shown by arrow BB, and the second aerofoil element 11 remains stationary. By virtue of being mounted on the base plate, the first and third aerofoil elements 10, 12 continue to rotate about axis 11*x*.

Figure 12:
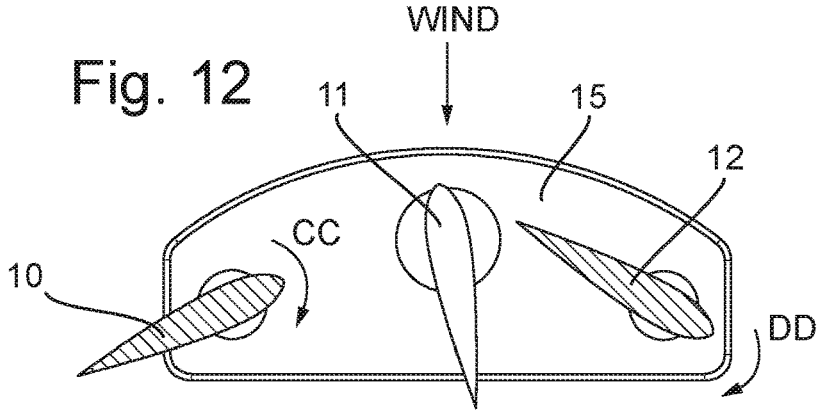
FIG. 12 shows a third stage of changing tack of the aerofoils of FIG. 9.

Then, as shown in FIG. 12, the first aerofoil element 10 and the second aerofoil element 12 start to rotate relative to the base plate, as shown by arrows CC and DD. Although shown separately here, it will be appreciated that the rotations shown by arrows AA, BB, CC, DD and EE may all take place simultaneously or as separate movements. It will be noted that in FIG. 12, the first and third elements are in their final positions relative to the base plate, but not relative to the second aerofoil element.

Figure 13:
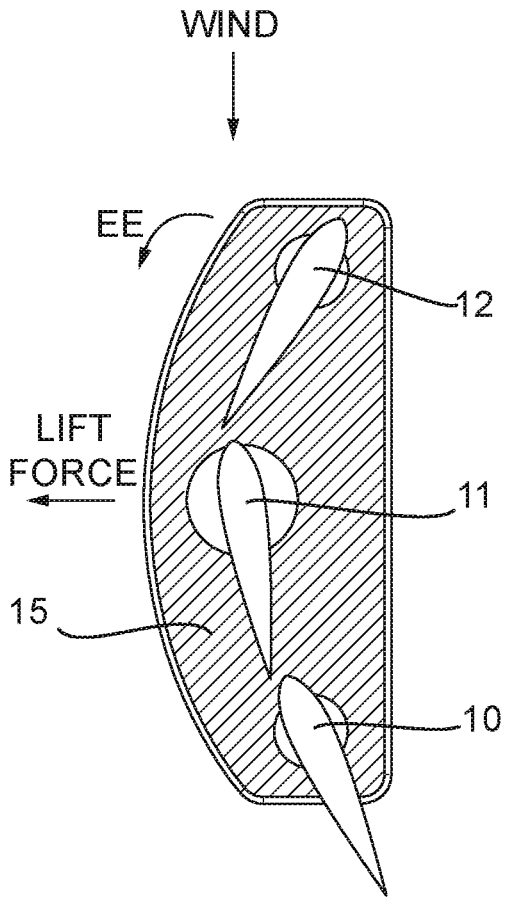
FIG. 13 shows the aerofoils of FIG. 9 when the change of tack is complete.

Finally, the base plate rotates such that it has rotated 180 degrees from its starting position, as shown by arrow EE in FIG. 13. By virtue of being mounted on the base plate, the first and third aerofoil elements move relative to the second aerofoil element, and in the final position, tack is complete, the camber of the array has been reversed (or inverted), and the wingsail produces lift in the opposite direction to that shown in FIG. 9. Again, the aerofoils have moved from a configuration in which flow from the trailing edge of the first element 10 is directed toward the leading edge of the second element 11, and flow from the trailing edge of the second element 11 is directed toward the leading edge of third element 12, to a configuration in which flow from the trailing edge of the third element 12 is directed toward the leading edge of the second element 11, and flow from the trailing edge of the second element 11 is directed toward the leading edge of first element 10. Thus, in both the first and second configurations, the flow travels over the aerofoil elements in the same direction relative to the individual aerofoil elements Although several particular possible sequences of movements of aerofoils are described above, it will be appreciated that the various aerofoil elements could be rotated in any order and in any direction, as long as the change in camber is achieved. For example, each aerofoil element could move at the same time, and/or in opposite directions to each other, and optionally simultaneously with the rotation of the entire wingsail. It will also be understood that, as described below, when arrangements with more than three aerofoils are used, the additional aerofoils are also moved in a similar manner to that described above.

It will also be understood that the angles through which the aerofoils are arranged to rotate may be chosen according to their function. At least one may be arranged to rotate about 360 degrees, and others may be arranged to rotate about 180 degrees. For example, the main spar, when connected to the second aerofoil 11, may be arranged to rotate 360 degrees about its axis and the first and third aerofoils 10, 12 may be arranged to rotate at least 180 degrees about their rotational axes. Alternatively, all of the aerofoils may be arranged to rotate 180 degrees about their rotational axes.

As shown in FIGS. 3-8 and 9-13, the system of the present invention allows the use of aerofoil elements that are symmetrically shaped around their chord line (i.e. not cambered) to be used to form an array with an overall cambered shape. This allows a very high lift configuration to be easily achieved on both tacks. In these aerofoil shapes, the distance from the thickest portion of each aerofoil to the leading edge is generally less than the distance from the thickest portion of each aerofoil to its trailing edge. That is, from the leading edge to the trailing edge, the thickness of the aerofoil increases and then decreases.

As shown in FIG. 3, the aerofoil elements have a rounded leading edge and a tapered trailing edge. Thus, the thickness of the aerofoil near the leading edge is larger than the thickness near the trailing edge. This may result in a configuration where the radius of curvature at the leading edge is larger than that at the trailing edge. Thus, the aerofoil elements have a well-defined leading edge and trailing edge, which are used as such regardless of the orientation of the aerofoil elements. It will be understood that the "tapered" trailing edge may be a sharp or pointed edge, may be truncated to form a flat surface, or may have a curved surface in cross section with a radius of curvature smaller than that of the trailing edge. This shape may provide optimum airflow over the aerofoil elements, and the pointed trailing edge may provide improved control over the slots mentioned above, because the point allows the airflow over the trailing edge to be directed precisely. In such a shape, the centre of area of the aerofoil section is typically closer to the leading edge of the aerofoil than the trailing edge of the aerofoil.

In order to provide the overall cambered array shape, the axis 11*x* about which the second element 11 rotates may be offset with respect to the other axes. In particular, when the axes 10*x*, and 12*x* are parallel to each other or intersect each other, the axis 11*x* may be offset with respect to a plane extending between the axes 10*x* and 12*x* about which the first and third aerofoil elements 10, 12 rotates. In other words, if a line is drawn in plan view (at the same height on the axis) between the axes 10*x* and 12*x* of the first aerofoil 10 and the third aerofoil 12, the axis of rotation of the second aerofoil element 11 does not lie on this line. It will be noted that the offset is such that, regardless of the tack of the wingsail, the first and third aerofoil elements are positioned toward the pressure side of the second aerofoil element.

The combination of the aerofoil element having an aerofoil section with a centre of area which is closer to its leading edge than its trailing edge, the aerofoil elements being arranged to form a cambered array (i.e. with the axis of the second element being offset relative to the others) with slots between the elements, and each aerofoil element being independently rotatable relative to each other, together with the whole wingsail assembly being rotatable relative to the vessel on which it is mounted, may allow a high lift configuration which can be adapted to any apparent wind. This may be achieved by adjusting the positions of the aerofoil elements relative to each other to trim the wingsail and provide maximum lift, and, where necessary, inverting the camber (as described above).

In some arrangements, one or both of the base plate 15 and end plate 16 may have moveable parts, which are able to change the position of the rotational axes of each aerofoil element (e.g. dynamically offset the axes relative to each other), and thus are able to vary the camber of the wingsail. In one arrangement, the base plate 15 and end plate 16 may comprise two articulating sections which are both rotatable around the axes 11*x*. The rotation of both sections may thus change the position of rotational axes 10*x* and 12*x* and thus adjust the camber of the wingsail. The wingsail could also be tacked in a different manner to above, in which the articulating sections of the base plate 15 and end plate 16 are rotated so as to reverse the camber of the wing.

In some arrangements, such as that shown in FIG. 1, each of the rotational axes 10*x*, 11*x*, 12*x* of the aerofoils are parallel. However, in some other arrangements, the axes of rotation may not be parallel, and further the relative positions of the axes to each other may vary with height.

It will be understood that, in the arrangements shown in FIGS. 1-3, the axis of rotation of each aerofoil element is located between the leading edge and the trailing edge of that aerofoil element. In other words, the axis is located inside the aerofoil itself, running parallel to the spanwise direction of the aerofoil, such that the aerofoil element rotates about itself. However, it will be understood that other arrangements are also possible. For example, the axis of rotation may lie at the leading edge of the aerofoil, or may lie outside the aerofoil.

In particular, the axis may be located closer to the leading edge than the trailing edge of the aerofoil elements. In other words, the axis is located in the first 50% of the chord. In some arrangements, the axis may preferably be located in the first third of the chord from the leading edge, more preferably at a location between 15% and 35% chord, and more preferably at a location between 20% and 30% chord. In particular, the axis of rotation may be positioned at or proximate the centre of pressure of the aerofoil. Typically, this might be at approximately 25% of the chord measured from the leading edge, but this may vary according to the shape of the aerofoil, its angle of attack and the orientation of the other aerofoil elements.

Figure 14:
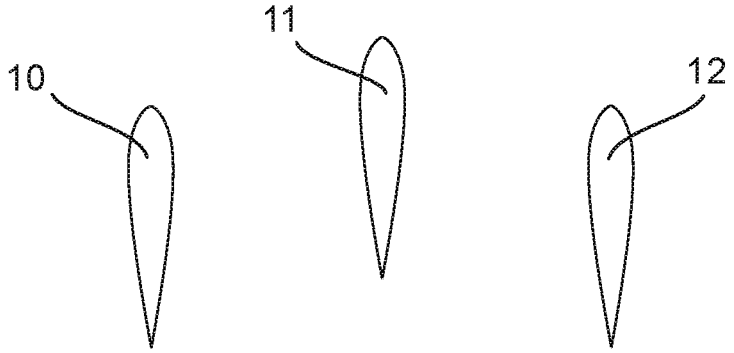
FIG. 14 shows a plan view of the aerofoils of FIG. 4 in a weathercocked configuration.

As described above, the aerofoils are rotatable to various different configurations in order to provide different overall cambered arrays. The aerofoils 10, 11, 12 can also move to other positions in which they do not form a cambered array. For example, as shown in FIG. 14, the aerofoils 10, 11, 12 move to a position in which all of their chord lines are parallel to each other. This may be, for example, a "weathercocked" configuration, in which the chord line of each aerofoil is aligned with the apparent wind direction. This may provide a failsafe mode, such that, if the control of the aerofoil is lost, or the wind is too powerful for the aerofoils to withstand, the aerofoils can be allowed to rotate freely and thus align to the apparent wind direction. In other failsafe arrangements, the aerofoils may be controlled by actuators or hydraulic rams to be moved to the desired positions, and also be biased to a weathercocked configuration by one or more resilient biasing members, such as springs, or other power storage devices such as accumulators or gas struts, so that they return to such a configuration in the event of power loss. Thus, when the device is powered, the actuators or hydraulic rams overcome the force of the resilient biasing members to control the positions of the aerofoils, and the device passively moves to a weathercocked configuration when there is no power.

Figure 15:
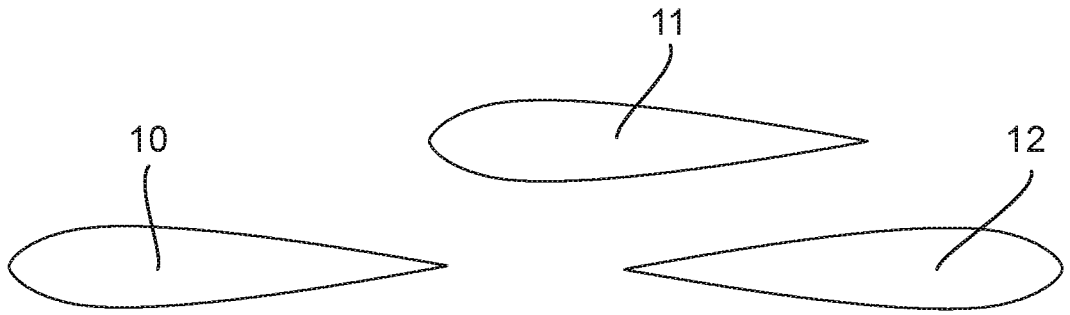
FIG. 15 shows a plan view of the aerofoils of FIG. 4 in a stowed configuration.

A further possible configuration that the aerofoils can be moved to is shown in FIG. 15. This configuration is a stowed configuration, in which the width and length of the wingsail is reduced or minimised. In this configuration, the chord lines are also parallel to each other, but two of the aerofoils (the first and second aerofoil elements, 10, 11) are substantially aligned in one direction, and the third aerofoil element 12 is aligned in a different direction. That is, the third aerofoil is disposed at an angle of 180 degrees relative to the other two aerofoil elements. This may provide a stowed configuration, in which the width (i.e. the left-right direction in FIG. 15) of the overall assembly is minimised. In other words, in contrast to the arrangement shown in, for example, FIGS. 3 and 10, the third aerofoil element 12 does not protrude beyond the edge of the base plate and end plate.

This configuration may be used when the wingsails are not being used, and for example, when the boat is docked, in order to minimise the space taken up by the wingsail 1.

The base plate 15 and end plate 16, as well as providing structural support for first and third elements 10 and 12, may also house any machinery and systems used to move the various components of the wingsail. Further, they may also reduce vortex shedding from the aerofoil elements.

Figure 16:
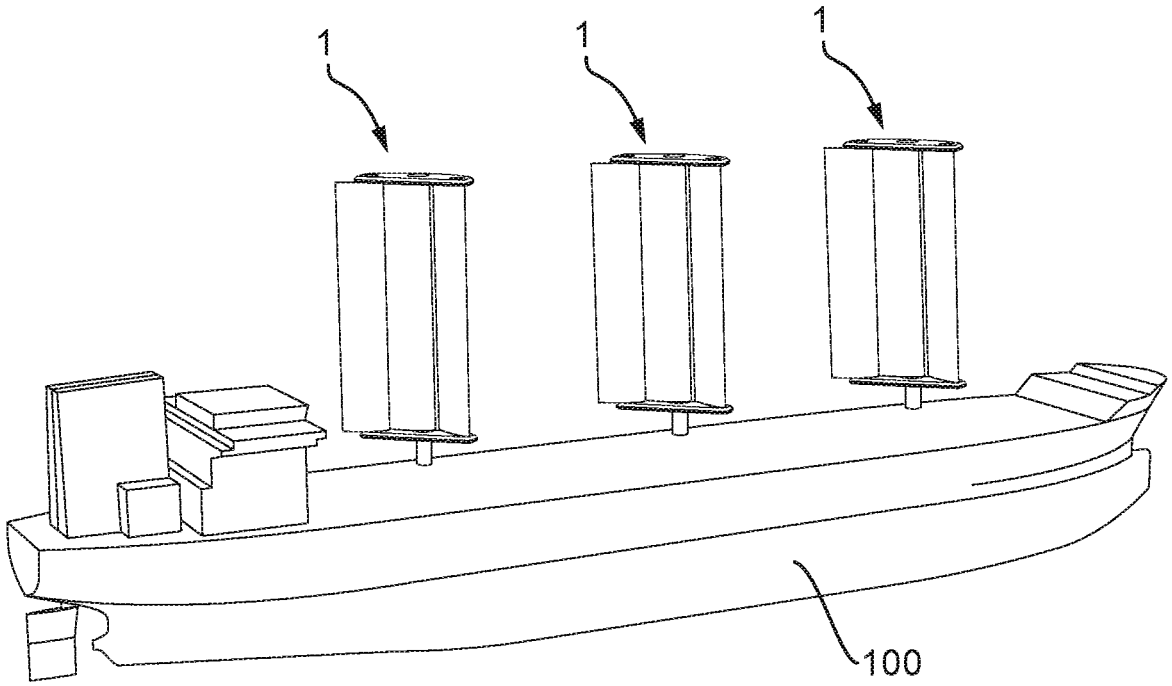
FIG. 16 shows a perspective view of a watercraft comprising wingsails according to the present invention.
Figure 17:
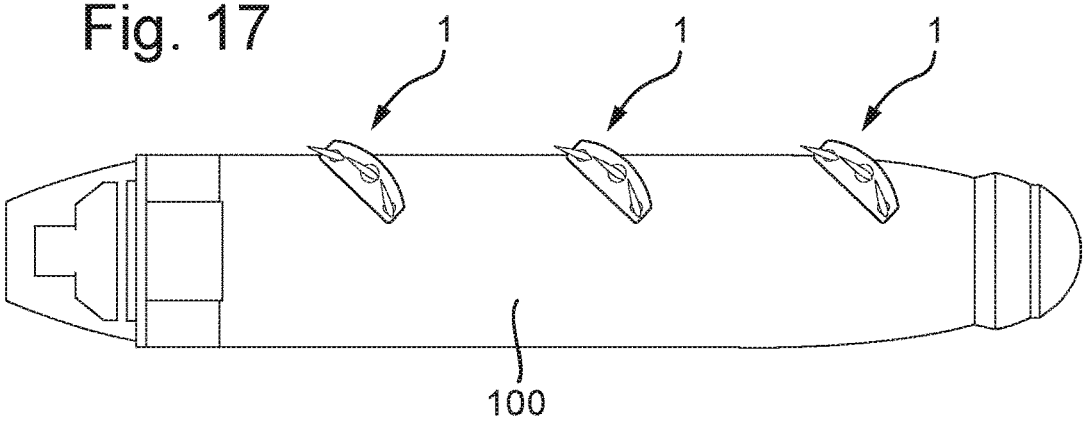
FIG. 17 shows a plan view of a watercraft comprising wingsails according to the present invention.
Figure 18A:
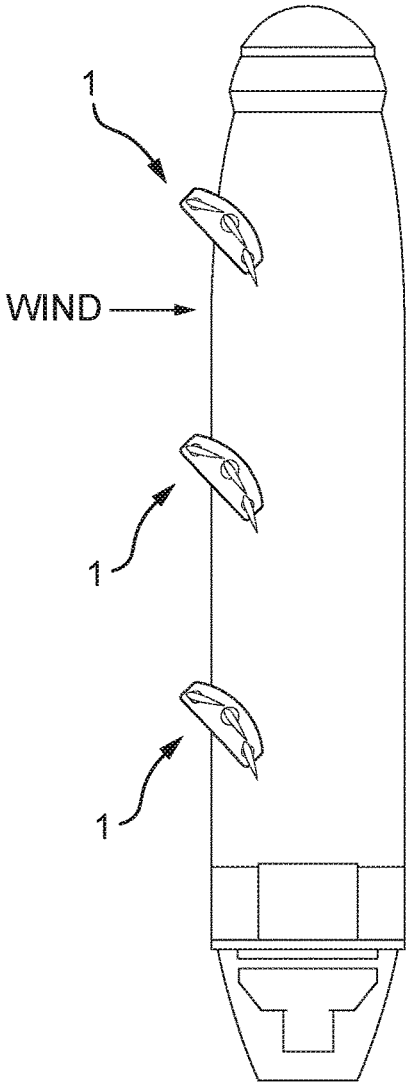
FIG. 18A shows the positioning of the aerofoils on a watercraft when the wind is impinging from a first direction.
Figure 18B:
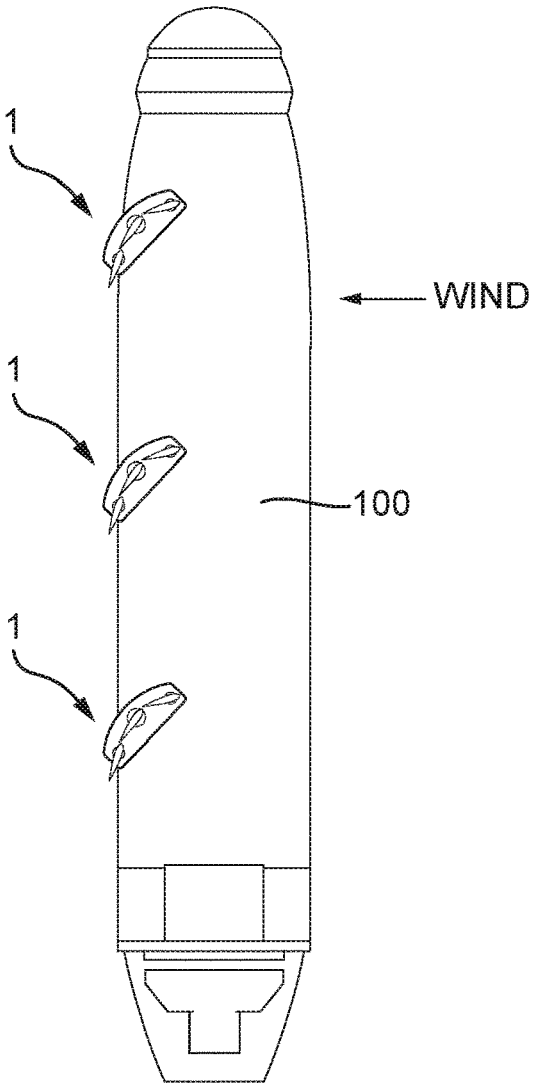
FIG. 18B shows the positioning of the aerofoils on a watercraft when the wind is impinging from a second direction.

As shown in FIGS. 16 and 17, one or more of the wingsails 1 may be mounted on a ship 100. The ship 100 may be, for example, a bulk carrier, a container ship, or any other suitable watercraft. In the arrangement shown in FIGS. 9 and 10, three wingsails 1 are shown. However, it will be understood that any number of wingsails 1 may be mounted on the ship 100, taking into account, for example, the size of the ship and the conditions in which it will be used. It will also be understood that the wingsails need not be mounted on the port side of the vessel but can be mounted in any suitable location. The main spar 14 may be rotatably mounted to the ship, and may be mounted through the deck of the ship, such that the weight of the wingsails (as well as any forces and moments generated by the interaction between the airflow and the wingsail) is held by the main spar. Thus, when the main spar, end plate, base plate and aerofoils themselves rotate, all of the rotations are relative to the watercraft. FIGS. 18A and 18B show the rotation of the wingsails relative to the ship such that lift can be produced when the wind is impinging from different directions. It will be understood that the wind directions in FIGS. 18A and 18B are at 180 degrees to each other, and that the wingsail can be adjusted accordingly when the wind is at an intermediate relative position.

The sequence of FIGS. 19-23 shows a turn being carried out by the ship, and the consequential adjustment of the wingsail. In these Figures, the wind is shown as impinging from the top of the diagram. It will be understood that this sequence could also be used in a situation in which the wind moves relative to the boat (i.e. changes direction), rather than the boat turning and thus changing direction relative to the wind. It should be understood that the following movements may be carried out using the same tacking process as described in relation to FIGS. 9-13.

Figure 19:
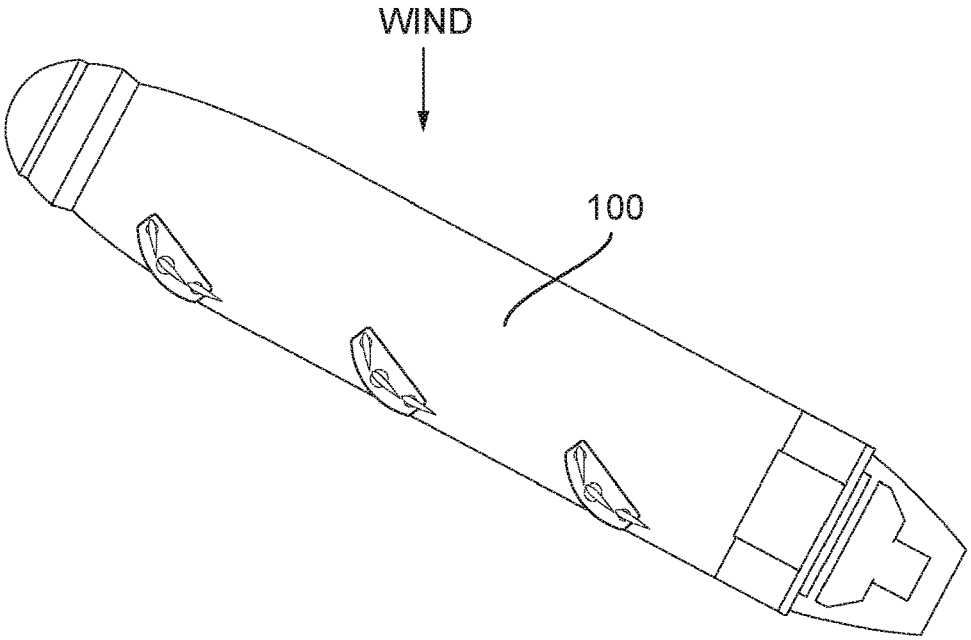
FIG. 19 shows the watercraft and an impinging wind before a turn.
Figure 20:
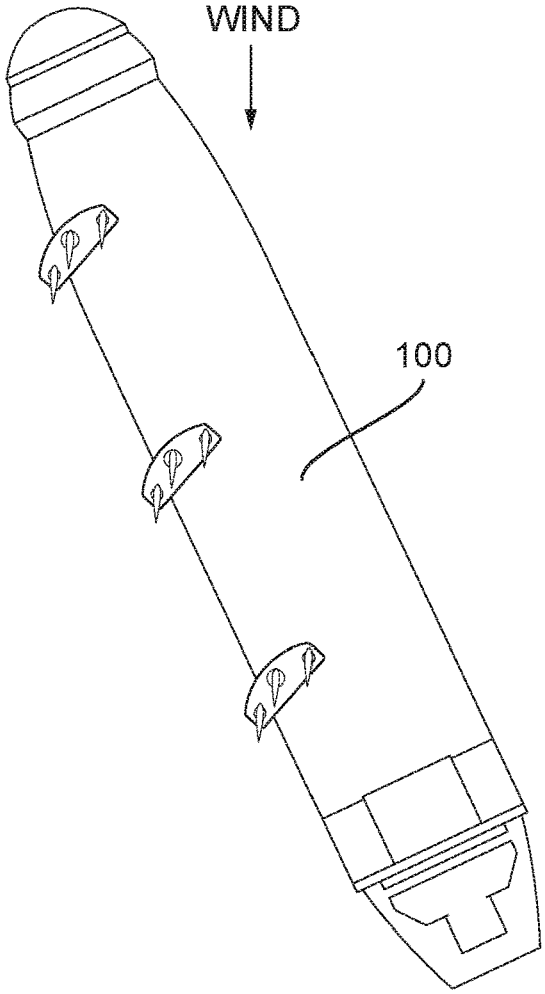
FIG. 20 shows the first stage of a turn of the watercraft of FIG. 19.

From the starting position shown in FIG. 19, the ship starts to turn clockwise in the view shown in the Figure (i.e. to starboard), to the position shown in FIG. 20. As shown in FIG. 20, the aerofoils are turned such that their chord lines are parallel to the apparent wind. This is done by turning the second aerofoil 11 and main spar 14, to which the second aerofoil element is connected, and by turning the base plate, on which the first and third aerofoil elements are mounted. The first and third aerofoil elements also rotate relative to the base plate such that their chord lines are parallel to the apparent wind. This results in the aerofoils being in a feathered configuration as the ship "travels through" the apparent wind.

Figure 21:
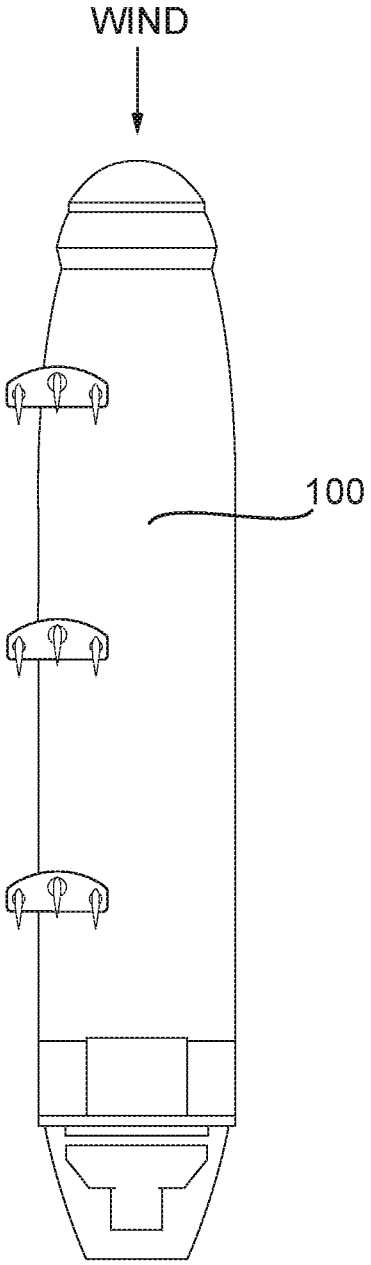
FIG. 21 shows the second stage of a turn of the watercraft of FIG. 19.
Figure 22:
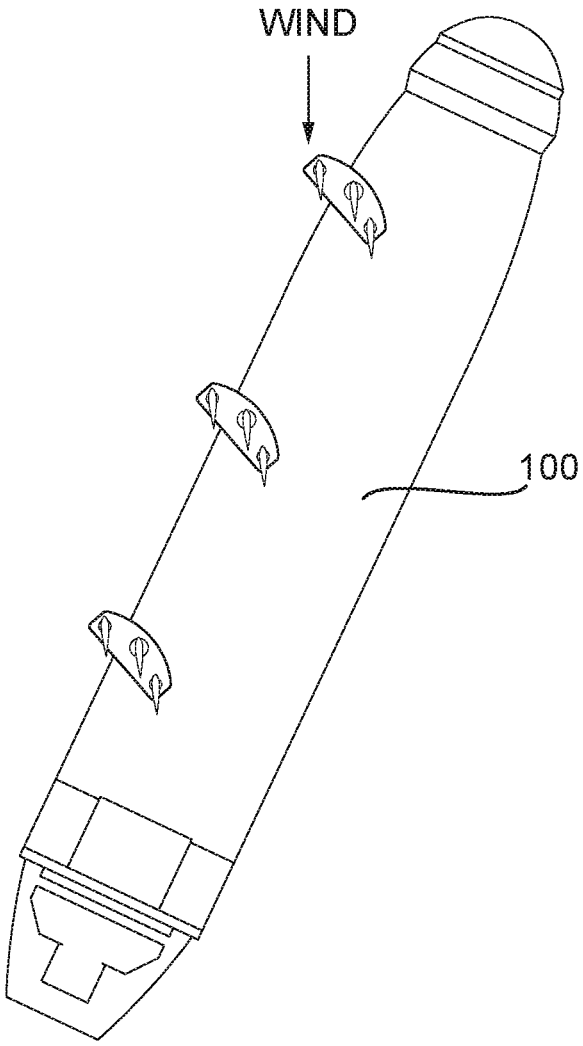
FIG. 22 shows the third stage of a turn of the watercraft of FIG. 19.
Figure 23:
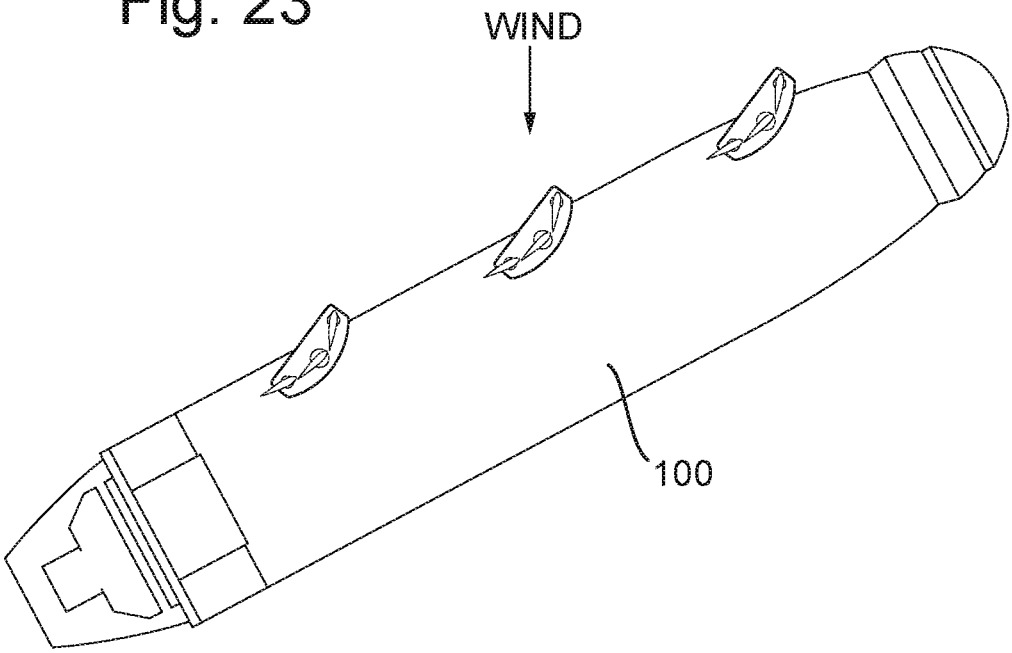
FIG. 23 shows the watercraft of FIG. 19 when the turn is complete.

The ship then continues to turn, through the positions shown in FIGS. 21 and 22, with the aerofoil elements continuing to rotate such that their chord lines are parallel to the apparent wind. Finally, when the ship has reached the position shown in FIG. 23, the aerofoil elements are moved such that they form the cambered array shape described above. It will be noted that in moving from the position shown in FIG. 19 to that of FIG. 23, the camber of the aerofoils has been reversed.

Figure 24:
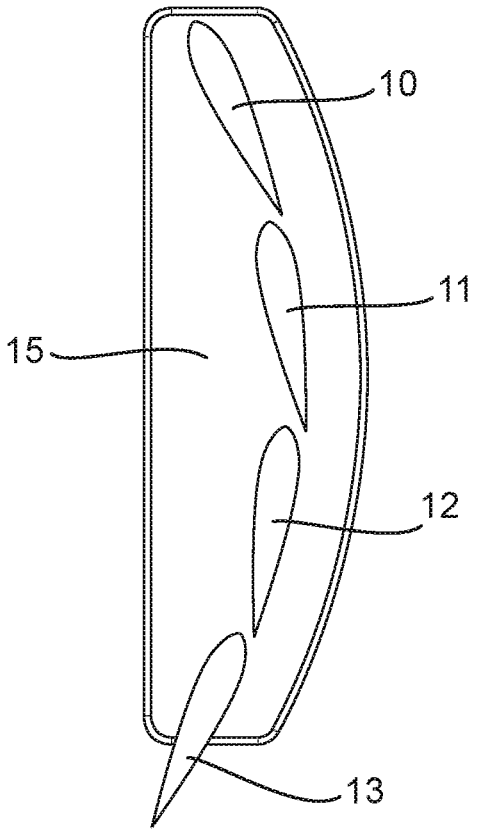
FIG. 24 shows a sectional plan view second arrangement of wingsail comprising four aerofoil elements.
Figure 25:
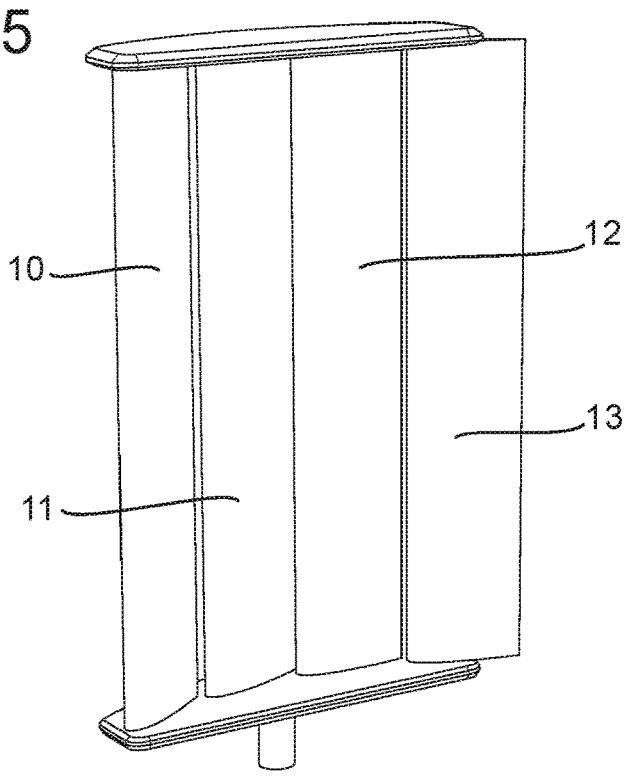
FIG. 25 shows a perspective view of a second arrangement of wingsail comprising four aerofoil elements.

FIGS. 24 and 25 show a second arrangement of wingsail 1. The wingsail shown in FIGS. 25 and 25 is similar to that as described above, but comprises a fourth aerofoil element 13 in addition to the first, second and third aerofoil elements 10, 11, 12. The fourth aerofoil element 13 may be independently rotatable relative to the other aerofoil elements, and may have an aerofoil section with a centre of area which is closer to its leading edge than its trailing edge. It will thus be understood that airflow from the trailing edge of the third aerofoil element is directed towards the leading edge of the fourth aerofoil element 13 in the configuration shown in FIG. 24. Although not illustrated, the wingsail shown in FIGS. 24 and 25 can change tack in the same way as shown in FIGS. 4-8 and described above. Namely, each of the aerofoil elements rotates, such that the camber of the overall array is reversed. Likewise, it can also move to the weathercocked and the stored configurations described above.

It will be appreciated that further aerofoil elements could also be added, with the airflow from the trailing edge of each element being directed to the leading edge of the next element. Likewise, the overall camber may be such that the axis of rotation of any given element does not lie in a plane extending between the two elements either side of that element.

Figure 26:
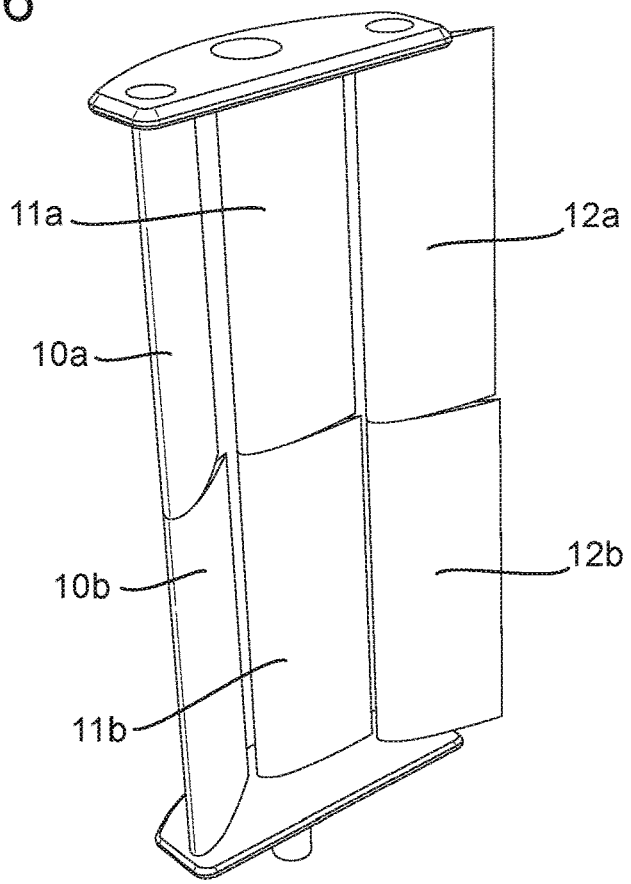
FIG. 26 shows a first perspective view of a third configuration of wingsail with the aerofoils divided into spanwise portions.
Figure 27:
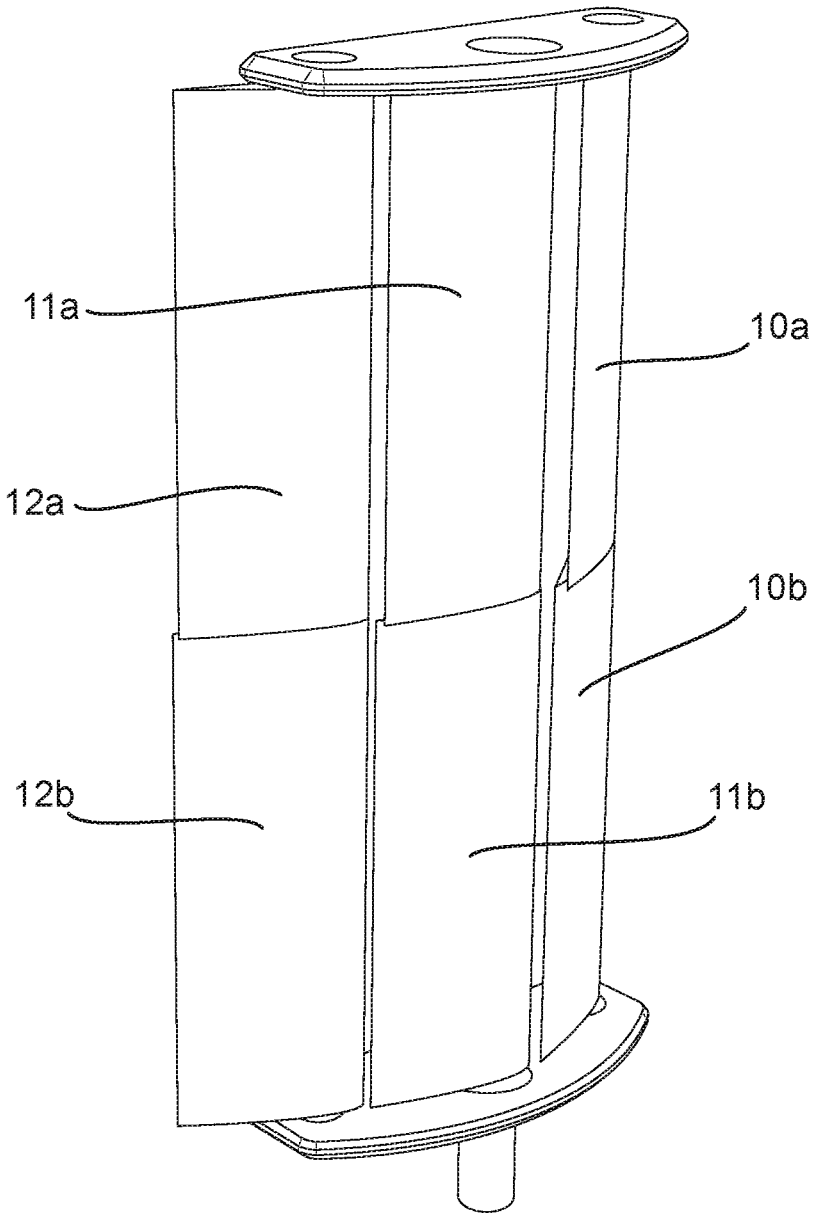
FIG. 27 shows a second perspective view of the wingsail of FIG. 15.

FIGS. 26 and 27 illustrate a third arrangement of wingsail 1 according to the present invention. This arrangement is similar to that shown in FIGS. 1-3, and differs in that each of the aerofoil elements is divided into two portions distributed along the span of the aerofoil. That is, the first aerofoil element 10 is divided into two portions 10*a*, 10*b* along its span, the second aerofoil element 11 is divided into two portions 11*a*, 11*b*, and the third aerofoil 12 is divided into elements 12*a*, 12*b* along its span. Each of the portions may be individually controllable, such that the two portions of each aerofoil can move relative to each other. This may allow the angle of attack of each aerofoil element to be varied along its span, and thus along the span of the wingsail. This may provide improved aerodynamics as the apparent wind direction and strength may vary with height.

Although the arrangement above has each aerofoil element divided into two portions, it will be appreciated that each aerofoil element could be divided into more than two portions, or that some of the aerofoil elements may be divided along the span, and others may form a single span. In some arrangements the aerofoil elements may be divided into a large number of portions along their span. This may result in the aerofoil elements being articulated to deform their surfaces, and thereby produce a varied shape along the span of the wingsail.

Figure 28:
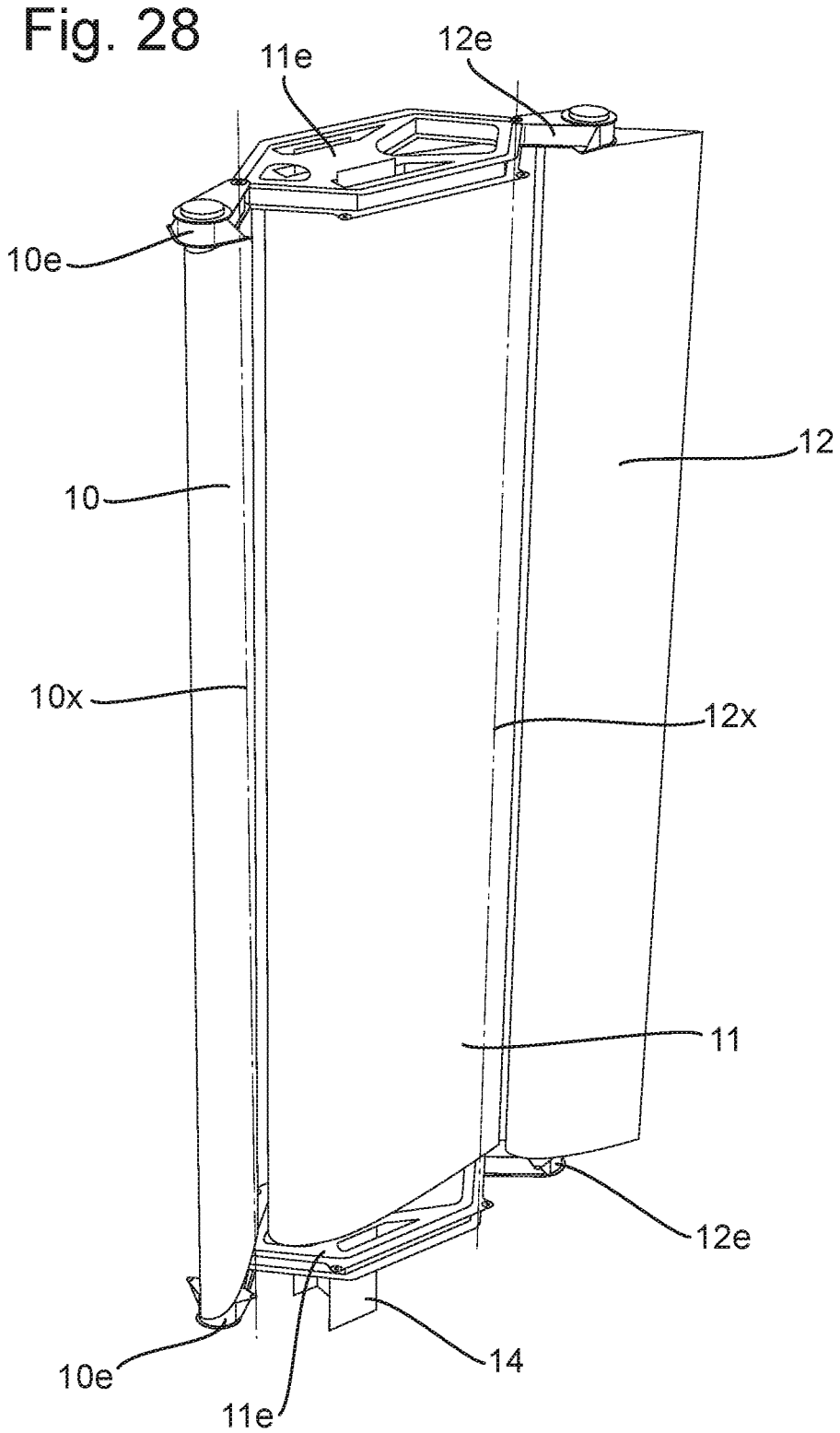
FIG. 28 shows a perspective view of a fourth configuration of wingsail.
Figure 29:
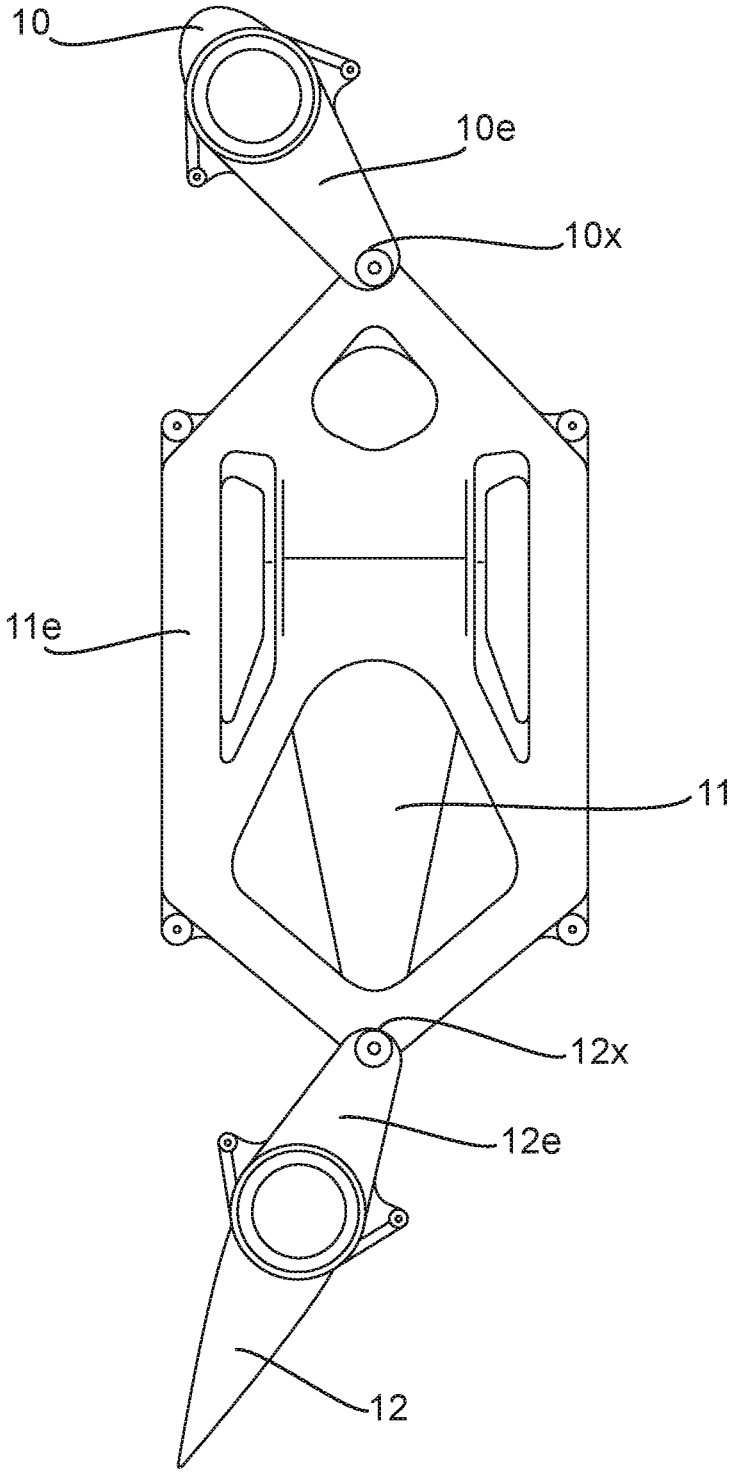
FIG. 29 shows a plan view of the configuration of FIG. 28.

FIGS. 28 and 29 illustrate a fourth arrangement of wingsail 1 according to the present invention. Similarly to the arrangement shown in FIGS. 1-3, the wingsail 1 includes a first aerofoil element 10, a second aerofoil element 11, and a third aerofoil element 12. The aerofoil elements may be substantially similar to those described above.

As shown in the plan view of FIG. 29, the aerofoils 10, 11, 12 can be moved to a configuration in which flow from the trailing edge of the first aerofoil element 10 is directed towards the leading edge of the second aerofoil element 11, and flow from the trailing edge of the second aerofoil element 11 is directed towards the leading edge of the third aerofoil element 12. It will be noted that together, the aerofoils form an array which has a cambered shape, as in the arrangement of FIGS. 1-3. Thus, air flow which impinges on the array at the first aerofoil element 10 is directed in succession to the second and third aerofoil elements, and flows around the array. It will be appreciated that in the array, each of the aerofoil elements provides lift along a vector from the concave to the convex side of the cambered array.

In the arrangement shown in FIGS. 28 and 29, the aerofoils are not mounted to a common end plate, as in the arrangement of FIGS. 1-3, but rather each aerofoil has its own respective end plate at each end of its span, on which the aerofoil is mounted. That is, the first aerofoil element 10 is mounted between two first end plates 10*e*, the second aerofoil element 11 is mounted between two second end plates 11*e*, and the third aerofoil element 12 is mounted between two third end plates 12*e*. The second end plate 12*e* may be connected to the main spar 14, as well as, or instead of, the second aerofoil element 12 (as described above). The rotational axes of the first and third aerofoil elements (10*x* and 12*x* respectively) are shown by dotted lines in FIG. 28.

As can be seen in FIG. 29, the first and second end plates are hingedly connected to each other about a pivot point, thus joining the first aerofoil element 10 to the second aerofoil element 11 and providing the rotational axis 10*x* of the first aerofoil element. Likewise, the second and third end plates are hingedly connected to each other about a pivot point, thus joining the third aerofoil element 12 to the second aerofoil element 11 and providing the rotational axis 12*x* of the third aerofoil element.

It will be noted from FIG. 29 that the shape of the end plate may be similar to the cross-sectional shape of the aerofoil element, or may be of a different shape. The shape of the end plates may be chosen in accordance with aerodynamic and/or structural considerations. For example, the first end plate 10*e* has a similar shape in plan view to the cross-sectional shape of the first aerofoil element 10, with the leading edge of the first aerofoil element extending beyond the first end plate 10*e*, and the first end plate 10*e* having additional protrusions. The second end plate 11*e* has a hexagonal shape, with the second aerofoil element being positioned within the hexagonal shape. The third end plate 12*e* extends beyond the leading edge of the third aerofoil element to join the second end plate 11*e*.

It will be appreciated that the particular arrangement of end plates shown in FIGS. 28 and 29 is merely exemplary, and that other arrangements are possible. For example, a single end plate for all three aerofoil elements, similar to that described above in relation to FIGS. 1 and 2, may also be adopted.

It will be noted that in this arrangement, the pivot point of the first aerofoil element 10 (and thus its rotational axis 10*x*) is located between the leading edge and the trailing edge of the first aerofoil element. In particular, the pivot point is located towards the trailing edge of the first aerofoil element. It will also be noted that, in this arrangement, the pivot point of the third aerofoil element (and thus its rotational axis 12*x*) is located between the leading edge and the trailing edge of the second aerofoil element 11. In other words, the pivot point of the third aerofoil element is located outside the third aerofoil element. In particular, the pivot point is located in the region of the trailing edge of the second aerofoil element. The pivot points may be chosen so as to provide the optimum shape of the overall camber of the combined array of aerofoils. The location of the pivot point may also coincide with the intersection of the projected chord line of each element when arranged in an optimal lift configuration. The arrangements of pivot points described above may allow high lift to be provided at the normal operating position of the wingsail, whilst allowing the camber to be conveniently reversed.

In the arrangement of FIGS. 28 and 29, in contrast to the arrangement shown in FIGS. 1-3, the camber of the array can be reversed (or inverted) by moving only two of the aerofoils. In particular, the first aerofoil element 10 is moved relative to the second aerofoil element 11, and the third aerofoil element 12 is moved relative to the second aerofoil element 11. The movement of each aerofoil is a rotation about the respective axes of the first and third aerofoil elements.

Figure 30:
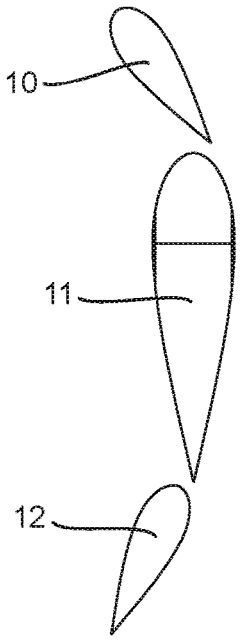
FIG. 30 shows the aerofoils of the wingsail of FIGS. 28 and 29, before initiation of a tack.
Figure 31:
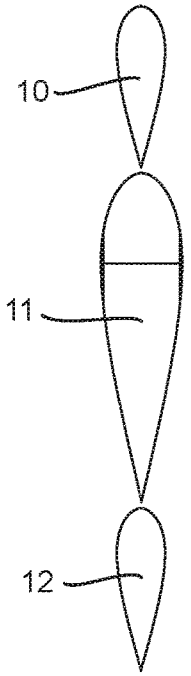
FIG. 31 shows the aerofoils of the wingsail of FIGS. 28 and 29, part way through a tack.
Figure 32:
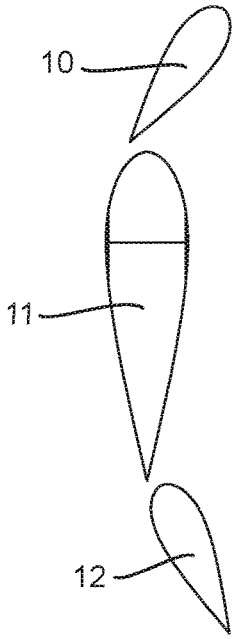
FIG. 32 shows the aerofoils of the wingsail of FIGS. 28 and 29, after a tack.

The movements of the aerofoils in order to change or reverse the overall camber of the array (and thus change the tack of the wingsail), is shown in FIGS. 30-32, in which the supporting structure of the aerofoils is omitted for ease of understanding.

FIG. 30 shows the aerofoil elements before the tacking process, FIG. 31 shows the aerofoil elements part way through the tacking process, and FIG. 32 shows the elements after the tacking process has been completed (and the camber has been reversed). It will be understood that this example is schematic, and the precise order of movements need not be as described below. For example, the first and third elements may either move simultaneously, or at different times.

Figure 33:
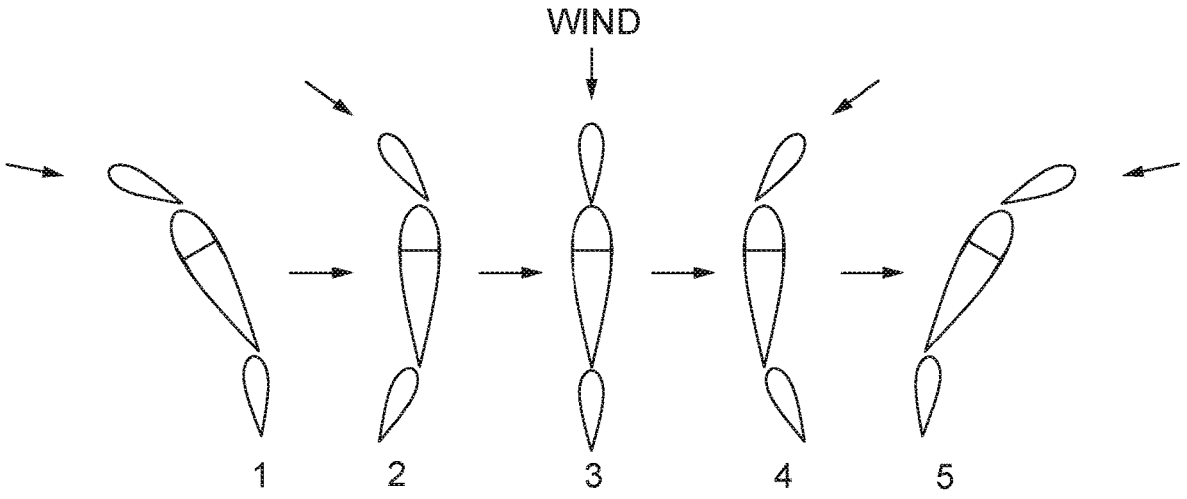
FIG. 33 shows a sequence showing a full tacking procedure, including the views of FIGS. 30-32.

FIG. 33 shows a complete tacking procedure, with the direction of the apparent wind reversing. It will be noted that the positions 2-4 are substantially similar to those shown in FIGS. 30-32, and reflect the movements described above in relation to those Figures. Positions 1 and 5 show that the entire wingsail may also rotate (relative to the vessel on which is it mounted) independently of the individual aerofoils. That is, between positions 1 and 2, the wingsail itself rotates anticlockwise to start the tack, and between positions 4 and 5, the wingsail itself likewise rotates anticlockwise to finish the tack. This may be achieved, for example, by rotating a main spar 14, as described above in relation to the other arrangements.

In the sequence shown in FIGS. 30-32, the first aerofoil element 10 rotates about approximately 70 degrees in a clockwise direction relative to the second aerofoil element 11. The third aerofoil element 12 rotates about approximately 50 degrees in an anticlockwise direction relative to the second aerofoil element 11. However, it will be understood that these values are only examples, and that the amount of rotation may vary in accordance with the shape of the overall camber of the wingsail. In general, the first aerofoil element 10 rotates through an angle of not more than 110 degrees, and preferably not more than 90 degrees. The third aerofoil element 12 also rotates through an angle of not more than 110 degrees, and preferably not more than 90 degrees. The rotation through angles of less than 110, and preferably less than 90 degrees, combined with the rotations of the first and third elements being in opposite angular directions (i.e. clockwise and anticlockwise) may allow the camber of the wingsail to be reversed whilst minimising movement of the individual parts. This in turn may lead to reduced manufacturing costs and/or increased reliability.

It will be noted that, in the arrangement shown in FIG. 31, the chord lines of each of the first, second and third aerofoil elements are parallel to each other, such that the three aerofoil elements are in a line "nose to tail". This is due to the rotational axis of the second element lying in a plane extending between the axes of the first and third elements. This contrasts with the arrangement shown in FIGS. 1-8 above, in which the rotational axis of the second element is offset with respect to the plane extending between the axes of the first and third elements.

Although the arrangement of FIG. 31 is shown as an intermediate step in the process of reversing the camber of the wingsail above, this configuration may also be adopted by the wingsail as a weathercocked configuration, with all of the aerofoil elements aligned with the apparent wind. In such a configuration, because each of the aerofoil elements is aligned with the apparent wind, and there is no overall camber, substantially no lift is produced. The manner by which the aerofoils move to the weathercocked configuration may be the same as described above.

Figure 36:
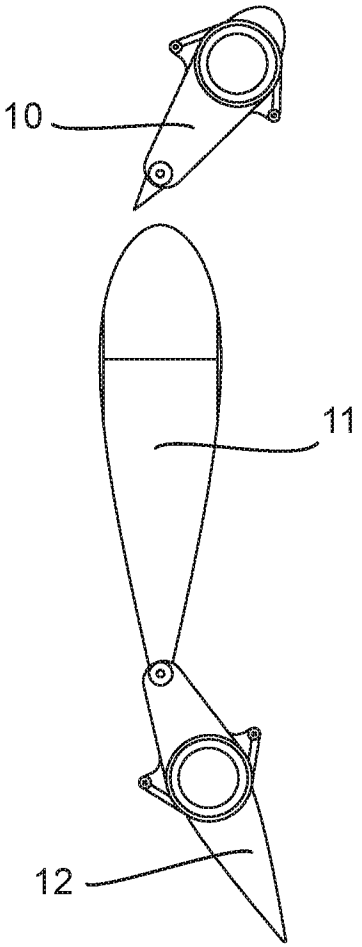
FIG. 36 shows the aerofoils of the wingsail of FIGS. 28 and 29, with the end plates included, after a tack.
Figure 35:
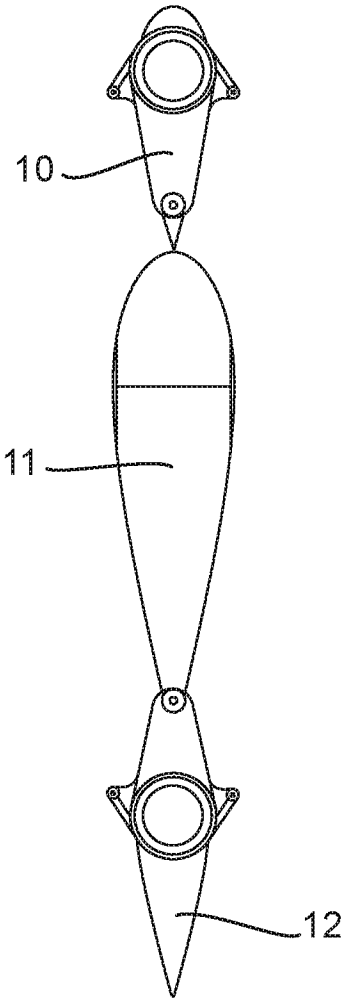
FIG. 35 shows the aerofoils of the wingsail of FIGS. 28 and 29, with the end plates included, part way through a tack.
Figure 34:
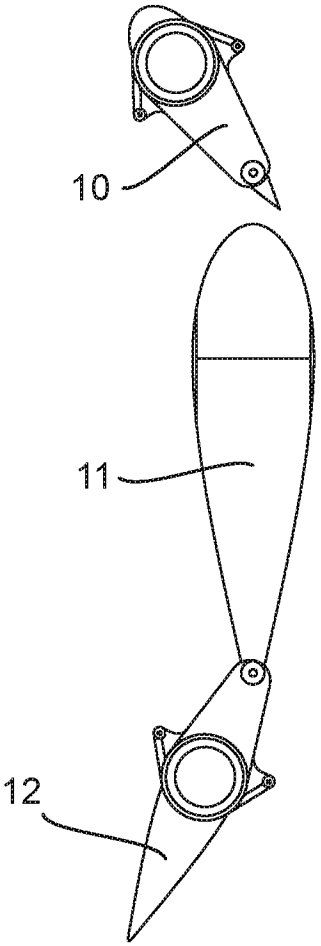
FIG. 34 shows the aerofoils of the wingsail of FIGS. 28 and 29, with the end plates included, before initiation of a tack.

FIGS. 34-36 show the pivoting sequence of FIGS. 30-32, with the pivot points about which the aerofoil elements can pivot, and the end plates of the first and third aerofoil elements shown. This provides another illustration that in this arrangement, the rotational axis of the first aerofoil element is located between the leading edge and the trailing edge of the first aerofoil element, and that the rotational axis of the third aerofoil element is located between the leading edge and the trailing edge of the second aerofoil element.

It will be understood that other arrangements for the locations of the pivots to those described above and shown in FIGS. 28-36 are possible. For example, the rotational axis of the first aerofoil element may be inside the first aerofoil element, and the rotational axis of the third aerofoil element may be inside the third aerofoil element. In another arrangement, the rotational axis of the first aerofoil element may be outside the first aerofoil element (and may be inside the second rotational element), and the rotational axis of the third aerofoil element may be outside the third aerofoil (and may be inside the second rotational element). In a yet further arrangement, the rotational axis of the first aerofoil element may be outside the first aerofoil element (and may be inside the second rotational element), and the rotational axis of the third aerofoil element may be inside the third aerofoil element. Again, as described above, the pivot points may be chosen so as to define the desired overall shape of the camber when the wingsail is on both tacks. Where rotational axes are located inside particular elements in these arrangements, they may be located at the percentages of chord length set out above.

In any of the above configurations, further aerodynamic devices may be added to one or more of the aerofoils, in any combination. For example, one or more of the aerofoils may include a leading edge slat. That is, a moveable portion may be provided at the leading edge of one or more of the aerofoils in order to increase the lift of the aerofoil. Further, boundary layer fences may be provided. That is, fixed devices which are elongate in a direction parallel to the chord of the aerofoils may be provided to reduce or prevent spanwise airflow.

The various components of the wingsail 1 may be formed of any suitable materials, and the following gives examples of such. It will also be understood that the various materials set out below may be combined. The structural elements of the aerofoil elements and the main spar may be formed of, or include, steel shell or solid steel bar, or another metallic alloy such as aluminium. These elements may also be formed of, or include structural composite such as carbon or E-glass and may be set with thermosetting resin. Similarly, the structural elements of the base plate and end plate may be formed of, or include steel shell or solid steel bar, or another metallic alloy such as aluminium. The structural elements may also be formed of, or include, structural composite such as carbon or E-glass which may be set with thermosetting resin.

The aerofoil elements may be formed of, or include, a structural central portion and a non-structural leading and trailing edge fairing which may be formed of, or include composite material such as carbon or E-glass which may be set with thermosetting resin. These composite parts may be formed in two or more pieces and subsequently bonded or fastened together. Alternatively the aerofoil elements may be of monocoque nature with or without internal structural frames.

The metallic structures and connecting parts may be fabricated, extruded, cast or printed using additive manufacturing techniques. The composite components may be manufactured using vacuum infusion, prepreg moulding or wet layup (either human or robotic).

The dimensions of the wing may vary depending on the application. In one embodiment of the invention, the wingsails may be fitted to a bulk carrier of approximately 200 m in waterline length. Each aerofoil element of the wingsail used with such a vessel may have a span above 30 m and a chord length greater than 5 m, the base of the elements may also be raised from the deck. However, it will be appreciated that the dimensions of the wingsail of the present invention are not limited thereto, and may be of any suitable size for the vessel on which they are to be mounted.

It will be understood that the movement of the various parts of the wingsail may be produced by any suitable actuation arrangement. In one embodiment of the invention, the main spar is attached through the deck and extends into the main body of the hull. The main spar may pivot around its axis on a bearing arrangement to allow the spar to rotate 360 degrees in either direction. The rotary position of the main spar may be changed by means of one or more slewing ring and worm drive gear systems acting on the axis of the main spar against the structure of the vessel.

In another embodiment of the invention, the main spar is rotated by means of one or more directly mounted rotary actuators. In yet another embodiment of the invention, one or more linear actuators attached to the structure of the vessel may operate a lever arm on the main spar to thereby move the main spar. In all of the above arrangements, the energy source used to move the parts of the wingsail may be provided by kinetic accumulation of hydraulic or pneumatic pressure, or direct electrical input.

The first and third aerofoil elements 10, 12 may have their vertical axis fixed relative to the axis of the main spar but be able to rotate independently of the main spar supported by one or more bearings within the base plate 15 and or end plate 16. The first and third aerofoils may be positioned by means of any of: a) a slewing ring and worm drive arrangement, b) one or more directly mounted rotary actuators, and c) one or more linear actuators attached to the base plate and/or end plate to operate a lever arm on the spar or a linear gear arrangement, or any combination thereof. The components by which this actuation is provided may be housed in either or both of the base plate 15 and end plate 16, or may be housed in the aerofoil elements themselves.

The base plate 15 and end plate 16 may be connected to the main spar by means of a top and bottom bearing, and the first and third aerofoil elements 10 and 12 may be connected to the base plate and end plate in a similar manner.

The wingsail 1 may be combined with a control system arrangement to control the wingsail. Namely, the control system may control the rotation of some or all of the spar, the aerofoil elements, and the rotation of the end plate and base plate. The control system may control the wingsail automatically, such as in response to a measured wind condition, or based on the input of a user. Thus, the controller may also be arranged to reverse or invert the camber of the array by commanding the aerofoil movements described above. The controller may also be arranged to control the size of the slots referred to above by, for example, adjusting the rotation of the aerofoil elements. The control system may be integrated with the control system of the watercraft itself.

The wingsails as described herein may each be capable of producing a significant amount of thrust in a wide range of wind conditions. In one embodiment of the invention, in which three wingsails are retrofitted to the bulk carrier previously described, the wingsails may be capable of producing enough thrust to propel the ship without the use of an engine in certain wind speeds and angles.

The wingsail and bulk carrier arrangements previously described may be capable of significantly reducing the ship's yearly fuel consumption and greenhouse gas emissions, especially when used in conjunction with route optimisation software. If the ship is fitted with modified appendages such as dagger boards or leeboards, the wingsails may be capable of reducing yearly fuel consumption and greenhouse gas emissions by an even greater amount.

The assessments of thrust and reductions in fuel consumption and greenhouse gas emissions are based on a number of global shipping routes simulated for both a ship with and without the use of wingsails. The simulations are repeated using thousands of varying start dates within six years of historic weather data to obtain a typical average yearly fuel saving. These simulations take into account full hydrodynamic and aerodynamic forces and moments acting on the ship and the wingsails.

There is also provided herein a method of controlling a wingsail for a powered watercraft, the wingsail comprising a first aerofoil element, a second aerofoil element, and a third aerofoil element, wherein each of the aerofoil elements is rotatable about an axis and has an aerofoil section with a centre of area which is closer to its leading edge than its trailing edge. The method comprises moving the aerofoils to a configuration in which flow from the trailing edge of one of the first or third element is directed toward the leading edge of the second element, and flow from the trailing edge of the second element is directed toward the leading edge of the other of the first or third element. In some arrangements, the aerofoil elements are arranged in an array to as to together form a cambered shape, and the method may include moving at least two of the aerofoil elements to reverse (or invert) the camber of the cambered shape. The movements may in particular be any of the movements described above.

It should be understood by those skilled in the art that while the present invention has been described with reference to exemplary embodiments, it is not limited to the disclosed exemplary embodiments. Various modifications, combinations, sub-combinations and alterations may occur depending on design requirements and other factors insofar as they are within the scope of the appended claims or the equivalents thereof. Features from any example or embodiment of the present disclosure can be combined with features from any other example or embodiment of the present disclosure.

The invention claimed is:

1. A wingsail for a powered watercraft comprising:

a first aerofoil element;

a second aerofoil element; and a third aerofoil element;

wherein:

each of the aerofoil elements is rotatable about an axis and has an aerofoil section with a center of area which is closer to its leading edge than its trailing edge;

the aerofoil elements are movable to a configuration in which flow from the trailing edge of one of the first or third element is directed toward the leading edge of the second element, and flow from the trailing edge of the second element is directed toward the leading edge of the other of the first or third element;

the aerofoil elements are arranged in an array so as to together form a cambered shape; at least two of the aerofoil elements are configured to rotate to thereby reverse the camber of the cambered shape; and the aerofoil elements are configured to be positioned such that a first slot is formed between the trailing edge of the first rigid aerofoil element and the leading edge of the second rigid aerofoil element, and a second slot is formed between the trailing edge of the second rigid aerofoil element and the leading edge of the third rigid aerofoil element, the slots being configured to regenerate airflow over the suction side of the aerofoil elements.

2. The wingsail according to claim 1, wherein the first and third aerofoil elements are configured to rotate in opposite rotational directions to each other to thereby reverse the camber of the cambered shape.

3. The wingsail according to claim 1, wherein the aerofoil elements are rotatable between:

a first configuration in which flow from the trailing edge of the first element is directed toward the leading edge of the second element, and flow from the trailing edge of the second element is directed toward the leading edge of third element; and a second configuration in which flow from the trailing edge of the third element is directed toward the leading edge of the second element, and flow from the trailing edge of the second element is directed toward the leading edge of first element;

wherein in both the first and second configurations, the flow travels over the aerofoil elements in the same direction relative to the individual aerofoil elements.

4. The wingsail according to claim 1, wherein at least one of:

the first aerofoil element is rotatable relative to the second aerofoil element;

the third aerofoil element is rotatable relative to the second aerofoil element;

the first and/or third aerofoil element is configured to rotate relative to the second aerofoil element by at most 110 degrees; and each of the aerofoil elements is independently rotatable to each of the other aerofoil elements about its respective rotational axis.

5. The wingsail according to claim 1, wherein the size of the slots is such that the distance between the leading edge and trailing edge of adjacent aerofoils is 20% or less of the chord of at least one of the aerofoils.

6. The wingsail according to claim 1, wherein the rotational axis of the first aerofoil element is located between the leading edge and the trailing edge of the first aerofoil element; or wherein the rotational axis of the first aerofoil element is located between the leading edge and the trailing edge of the second aerofoil element.

7. The wingsail according to claim 1, wherein the rotational axis of the third aerofoil element is located between the leading edge and the trailing edge of the second aerofoil element; or wherein the rotational axis of the third aerofoil element is located between the leading edge and the trailing edge of the third aerofoil element.

8. The wingsail according to claim 1, wherein at least one of:

each respective rotational axis is located between the leading edge and the trailing edge of its respective aerofoil element the rotational axis of each aerofoil element is located closer to the leading edge than the trailing edge of each respective aerofoil element;

the rotational axis of each aerofoil element is located in the first third of the chord from the leading edge;

the rotational axis of the second element is offset with respect to a plane extending between the axes of the first and third elements; and each of the rotational axes are parallel to each other.

9. The wingsail according to claim 1, wherein at least one of:

the aerofoil elements are symmetrically shaped about their chord line;

the distance from the thickest portion of each aerofoil element to the leading edge is less than the distance from the thickest portion of each aerofoil element to the trailing edge; and the section of each aerofoil element is substantially uniform along the span of the aerofoil element.

10. The wingsail according to claim 1, further comprising a fourth aerofoil element, the fourth aerofoil element having an aerofoil section with a center of area which is closer to its leading edge than its trailing edge, wherein the aerofoil elements are movable to a configuration in which flow from the trailing edge of the third element is directed toward the leading edge of the fourth element.

11. The wingsail according to claim 10, wherein the fourth aerofoil element is independently rotatable relative to the other aerofoil elements about a rotational axis located between the leading edge and the trailing edge of the fourth aerofoil element.

12. The wingsail according to claim 1, wherein at least one of the aerofoil elements is divided into two or more portions distributed along the span of the aerofoil, each portion being independently rotatable relative to the other portions.

13. The wingsail according to claim 1, wherein the aerofoil elements are rotatable to a weathercocked configuration in which the chord line of each aerofoil element is substantially aligned with an apparent wind direction.

14. The wingsail according to claim 13, wherein the aerofoil elements are biased to the weathercocked configuration by one or more resilient biasing members.

15. The wingsail according to claim 1, wherein the aerofoil elements are rotatable to a stowed configuration in which the chord lines of each aerofoil element are substantially parallel to each other and the trailing edges of the first and third aerofoil are facing each other.

16. The wingsail according to claim 1, wherein at least one of the aerofoils comprises a leading edge slat and/or one or more boundary layer fences.

17. The wingsail according to claim 1, wherein the second aerofoil element is mounted to a main spar arranged to support the weight of the wingsail.

18. The wingsail according to claim 17, wherein the aerofoils are mounted on a base plate and are rotatable relative to the base plate, the base plate being rotatably mounted on the main spar.

19. The wingsail according to claim 18, further comprising an end plate mounted at the opposite end of the span of the aerofoils to the base plate such that the aerofoils are mounted between the base plate and the end plate, the end plate being rotatably mounted on the main spar.

20. The wingsail according to claim 1, wherein the aerofoil elements are arranged such that the rotational axes of at least two of the aerofoil elements are moveable relative to each other.

21. A system comprising a wingsail according to claim 1, and a controller arranged to control the rotation of the aerofoil elements, wherein the controller is arranged to rotate the aerofoils automatically in response to at least one of a measured wind condition, a measured force on the wingsail or a measured moment on the wingsail.

22. The system according to claim 21, wherein the aerofoil elements are arranged in an array so as to together form a cambered shape, and the controller is arranged to rotate at least two of the aerofoil elements to thereby reverse the camber of the cambered shape.

23. A watercraft comprising a wingsail according to claim 1.

24. The wingsail according to claim 4, wherein the first and/or third aerofoil element is configured to rotate relative to the second aerofoil element by at most 90 degrees.

25. The wingsail according to claim 8, wherein the rotational axis of each aerofoil element is located at a location between 15% and 35% of the chord from the leading edge.

26. The wingsail according to claim 8, wherein the rotational axis of each aerofoil element is located at a location between 20% and 30% of the chord from the leading edge.

27. A wingsail for a powered watercraft comprising:

a first aerofoil element;

a second aerofoil element; and a third aerofoil element;

wherein:

each of the aerofoil elements is rotatable about an axis and has an aerofoil section with a center of area which is closer to its leading edge than its trailing edge;

the aerofoil elements are movable to a configuration in which flow from the trailing edge of one of the first or third element is directed toward the leading edge of the second element, and flow from the trailing edge of the second element is directed toward the leading edge of the other of the first or third element;

the aerofoil elements are arranged in an array so as to together form a cambered shape;

at least three of the aerofoil elements are configured to rotate relative to each other to thereby reverse the camber of the cambered shape; and the aerofoil elements are configured to be positioned such that slots are formed between the first aerofoil element and the second aerofoil element, and between the second aerofoil element and the third aerofoil element, the slots being configured to regenerate airflow over the suction side of the aerofoil elements.

* * * * *